US009732560B2

(12) United States Patent
Fontana et al.

(10) Patent No.: US 9,732,560 B2
(45) Date of Patent: Aug. 15, 2017

(54) DRILLING TOOL AND APPARATUS

(71) Applicant: VERMEER MANUFACTURING COMPANY, Pella, IA (US)

(72) Inventors: Christopher R. Fontana, Pella, IA (US); Keith Allen Hoelting, Dallas, IA (US); Randy R. Runquist, Knoxville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 349 days.

(21) Appl. No.: 14/461,018

(22) Filed: Aug. 15, 2014

(65) Prior Publication Data

US 2015/0060148 A1 Mar. 5, 2015

Related U.S. Application Data

(60) Provisional application No. 61/871,528, filed on Aug. 29, 2013.

(51) Int. Cl.

| | |
|---|---|
| ***E21B 17/046*** | (2006.01) |
| ***E21B 7/06*** | (2006.01) |
| ***E21B 10/16*** | (2006.01) |
| ***E21B 10/633*** | (2006.01) |
| ***E21B 47/01*** | (2012.01) |
| ***E21B 7/04*** | (2006.01) |

(52) U.S. Cl.

CPC ..... *E21B 7/064* (2013.01); *E21B 7/04* (2013.01); *E21B 10/16* (2013.01); *E21B 10/633* (2013.01); *E21B 47/01* (2013.01)

(58) Field of Classification Search

CPC . Y10T 403/7039; E21B 7/064; E21B 17/046; E21B 10/62; E21B 17/04

See application file for complete search history.

(56) References Cited

U.S. PATENT DOCUMENTS 3,685,601 A 8/1972 Hollingshead
3,744,577 A * 7/1973 Williams ..... E21B 3/02 173/213

(Continued)

OTHER PUBLICATIONS

International Search Report and Written Opinion for Application No. PCT/US2011/059990 mailed Jun. 22, 2012.

(Continued)

*Primary Examiner* — Kipp Wallace

(74) *Attorney, Agent, or Firm* — Merchant & Gould P.C.

(57) ABSTRACT

A drilling apparatus including a rotary cutting tool having a proximal end and a distal end and further defining a rotary axis generally extending between the proximal and distal ends. The rotary cutting tool includes a proximally directed face located between the proximal and distal ends that face mainly in a proximal direction. The rotary cutting tool also includes an angled mounting face that extends between the proximally directed face and the proximal end. The angled mounting face is angled relative to the proximally directed face and the rotary axis where one of a mounting aperture and a mounting protrusion are provided at the proximally directed face. The one of the mounting aperture and the mounting protrusion have a mounting depth that extends generally in the direction of the rotary axis. The distal end includes a feature that is configured for at least one of cutting and grinding.

49 Claims, 22 Drawing Sheets

(56) References Cited

U.S. PATENT DOCUMENTS

| | | | | |
|---|---|---|---|---|
| 4,773,491 | A * | 9/1988 | Shy | E21B 7/201 175/385 |
| 5,020,608 | A | 6/1991 | Odén et al. | |
| 5,148,880 | A | 9/1992 | Lee et al. | |
| 5,253,721 | A | 10/1993 | Lee | |
| 5,469,926 | A | 11/1995 | Lessard | |
| 5,645,132 | A | 7/1997 | Åsberg | |
| 5,899,283 | A | 5/1999 | Cox | |
| 5,931,240 | A | 8/1999 | Cox | |
| 5,934,391 | A | 8/1999 | Cox | |
| 5,950,743 | A | 9/1999 | Cox | |
| 6,148,935 | A | 11/2000 | Wentworth et al. | |
| 6,209,660 | B1 | 4/2001 | Cox | |
| 6,260,634 | B1 | 7/2001 | Wentworth et al. | |
| 6,263,983 | B1 | 7/2001 | Wentworth et al. | |
| 6,390,087 | B1 | 5/2002 | Wentworth et al. | |
| 6,422,782 | B1 | 7/2002 | Wentworth | |
| 6,450,269 | B1 | 9/2002 | Wentworth et al. | |
| 6,470,979 | B1 | 10/2002 | Wentworth et al. | |
| 6,484,823 | B2 | 11/2002 | Olsson et al. | |
| 6,581,680 | B1 | 6/2003 | Wentworth | |
| 6,588,515 | B2 | 7/2003 | Wentworth et al. | |
| 6,810,971 | B1 | 11/2004 | Sved | |
| 6,810,972 | B2 | 11/2004 | Sved | |
| 6,810,973 | B2 | 11/2004 | Sved | |
| 6,814,168 | B2 | 11/2004 | Sved | |
| 6,827,159 | B2 | 12/2004 | Sved | |
| 7,172,035 | B2 | 2/2007 | Michael et al. | |
| 2002/0170713 | A1 | 11/2002 | Haugen et al. | |
| 2004/0173381 | A1 | 9/2004 | Moore et al. | |
| 2006/0008336 | A1* | 1/2006 | Neumann | B23B 31/008 409/234 |
| 2006/0151213 | A1 | 7/2006 | Michael et al. | |
| 2007/0029113 | A1 | 2/2007 | Chen | |
| 2011/0266066 | A1 | 11/2011 | Viel et al. | |
| 2012/0118640 | A1 | 5/2012 | Runquist et al. | |
| 2012/0241218 | A1* | 9/2012 | Chau | E21B 47/011 175/45 |
| 2014/0224545 | A1* | 8/2014 | Nicol-Seto | E21B 17/03 175/107 |

OTHER PUBLICATIONS

International Search Report and Written Opinion for Application No. PCT/US2014/051325 mailed Nov. 27, 2014.

* cited by examiner

DRILLING TOOL AND APPARATUS

CROSS-REFERENCE TO RELATED APPLICATION

This present application claims priority to U.S. Provisional Patent Application Ser. No. 61/871,528, and filed on Aug. 29, 2013, the disclosure of which is hereby incorporated by reference in its entirety.

TECHNICAL FIELD

The present invention relates generally to underground drilling equipment. More particularly, the present disclosure relates to drill heads and sonde housings adapted to be mounted at the end of a drill string.

BACKGROUND

Underground drilling systems often use a rotary drilling tool to form a bore in the ground. The rotary drilling tool is typically mounted at a distal end of a drill string including a plurality of drill rods (e.g., drill pipes) strung together end-to-end. The drill string transfers thrust and torque from a proximal drive mechanism (e.g., an above-ground drive mechanism) to the rotary drilling tool. In this way, the drill string is used to rotate the rotary drilling tool about a longitudinal axis of the drill string and is concurrently used apply thrust in a distal direction to the rotary drilling tool. Drill rods are progressively added to the drill string to increase the length of the bore. For certain applications, the rotary drilling tool includes structure (e.g., a slanted/angled face) that allows the rotary drilling tool to be steered to control the direction in which the bore is drilled. A sonde can be provided adjacent the rotary drilling tool for use in monitoring operational parameters of the rotary drilling tool such as pitch and rotational orientation (i.e., roll or clock position). The sonde can also work with other equipment to allow a geographic position of the drilling tool to be determined. The sonde typically interfaces with a control system that used to control the direction in which the rotary drilling tool travels. An example drilling system including a sonde is disclosed in U.S. Pat. No. 7,172,035, which is hereby incorporated by reference in its entirety.

SUMMARY

Certain aspects of the present disclosure relate to techniques and arrangements for coupling rotary cutting tools to drive members such as sonde housings.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Figure 1:
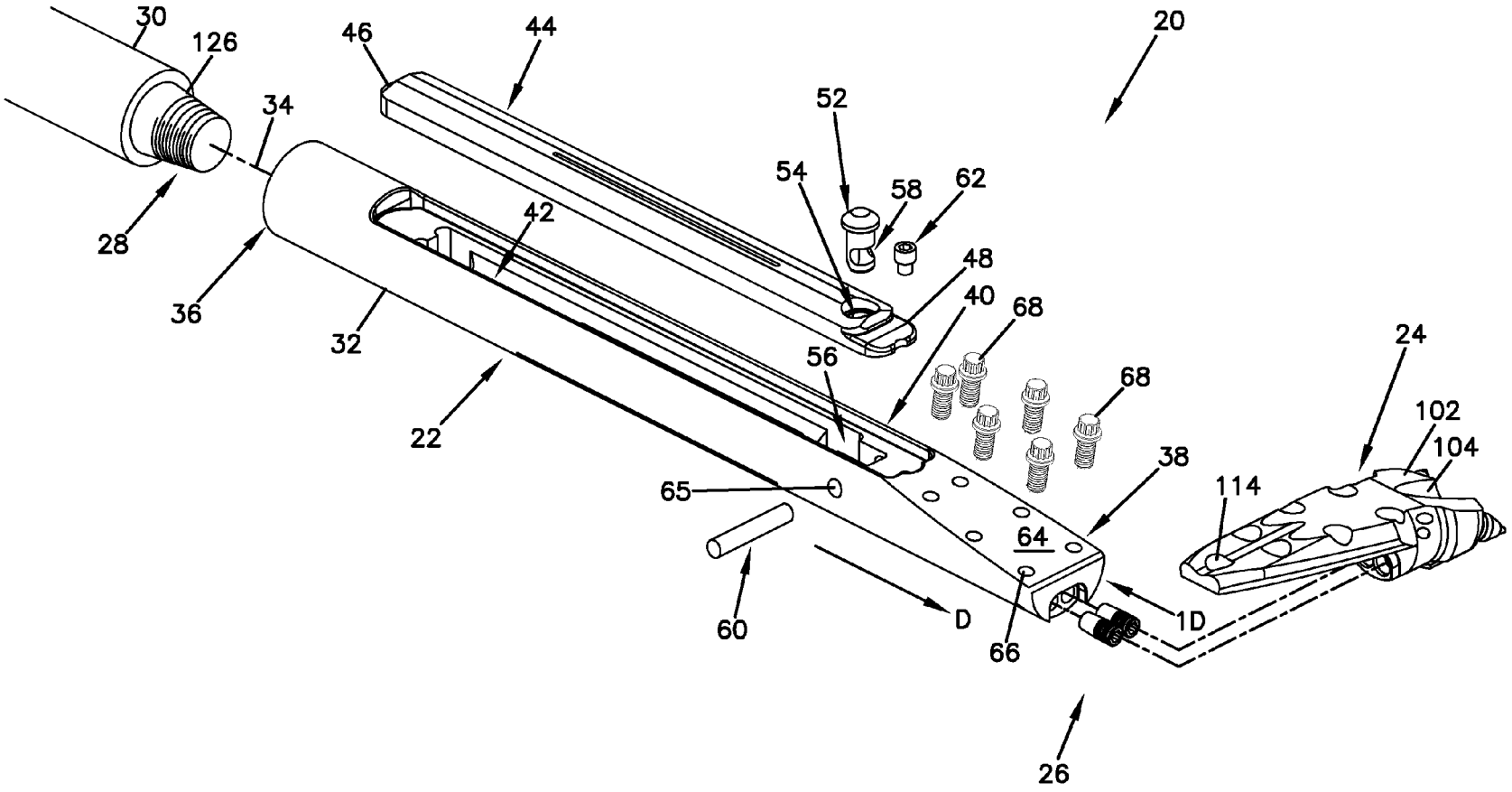
FIG. 1 is an exploded, perspective view of a sonde housing and rotary cutting tool in accordance with the principles of the present disclosure.

FIG. 1 illustrates a drilling apparatus 20 in accordance with the principles of the present disclosure. The drilling apparatus 20 includes a sonde housing 22 (e.g., connection component) and a rotary cutting tool 24 (i.e., a rotary drilling tool) that mounts to the sonde housing 22. A coupling interface 26 can be provided between the sonde housing 22 and the rotary cutting tool 24. The drilling apparatus 20 can be adapted for connection to a distal end 28 of a drill string 30 such that the drill string 30 can be used to rotate the drilling apparatus 20 in a rotational cutting motion about a central axis of rotation of the drill string 30.

The coupling interface 26 can be adapted to mechanically secure the rotary cutting tool 24 to the sonde housing 22 such that torque can be transferred between the sonde housing 22 and the rotary cutting tool 24. Additionally, the coupling interface 26 can be configured to insure that the rotary cutting tool 24 remains attached to the sonde housing 22 during drilling operations, and also allow thrust and pull back loads to be transferred from the sonde housing 22 to the rotary cutting tool 24. The coupling interface 26 can also configured to allow the rotary cutting tool 24 to be quickly coupled and uncoupled from the sonde housing 22.

Figure 2:
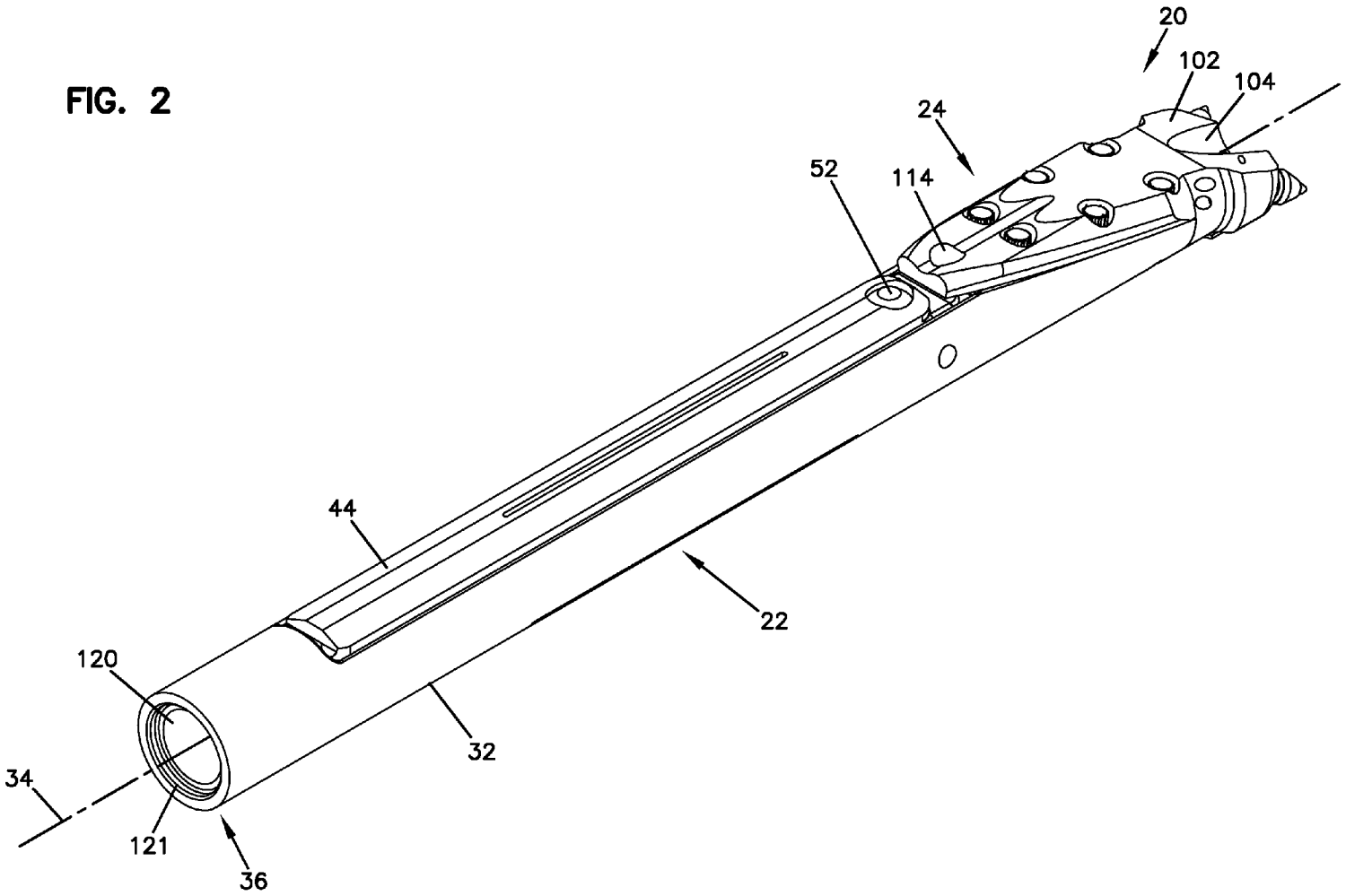
FIG. 2 is a proximal end perspective view of the sonde housing and rotary cutting tool of FIG. 1 with the rotary cutting tool coupled to the sonde housing.
Figure 3:
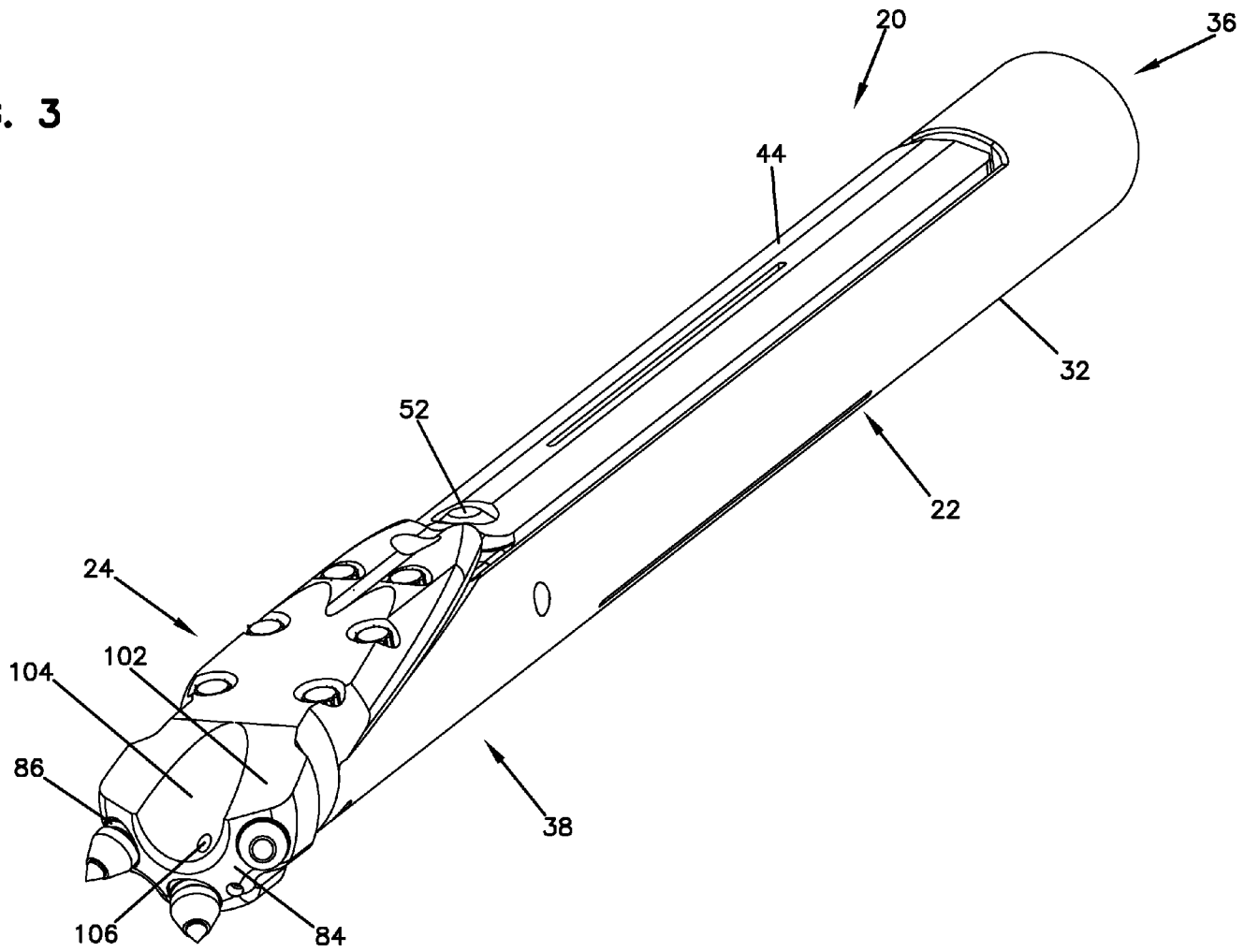
FIG. 3 is a distal end perspective view of the sonde housing and the rotary cutting tool of FIG. 2 with the rotary cutting tool coupled to the sonde housing.
Figure 13:
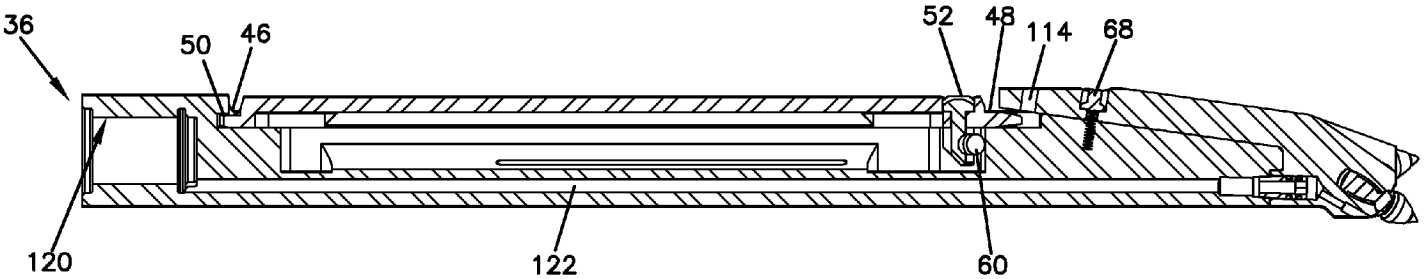
FIG. 13 is a cross-sectional view taken along section line 13-13 of FIG. 12.
Figure 14:
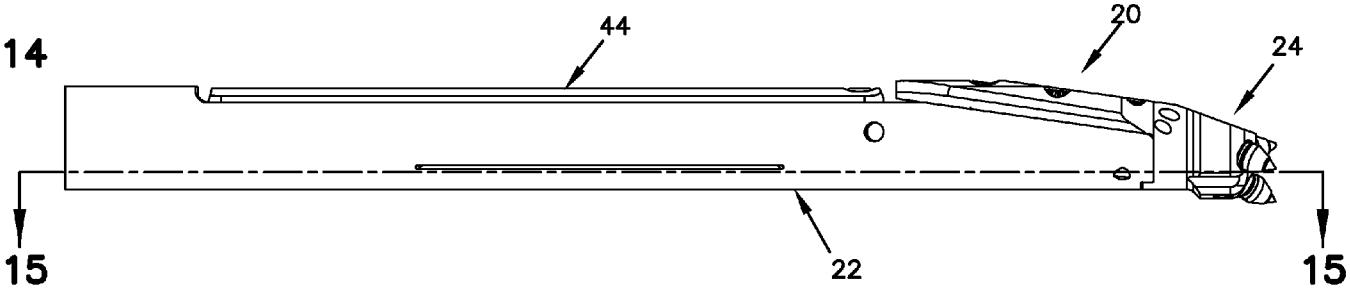
FIG. 14 is a side view of the sonde housing and rotary cutting tool of FIG. 1 shown coupled to one another.
Figure 15:
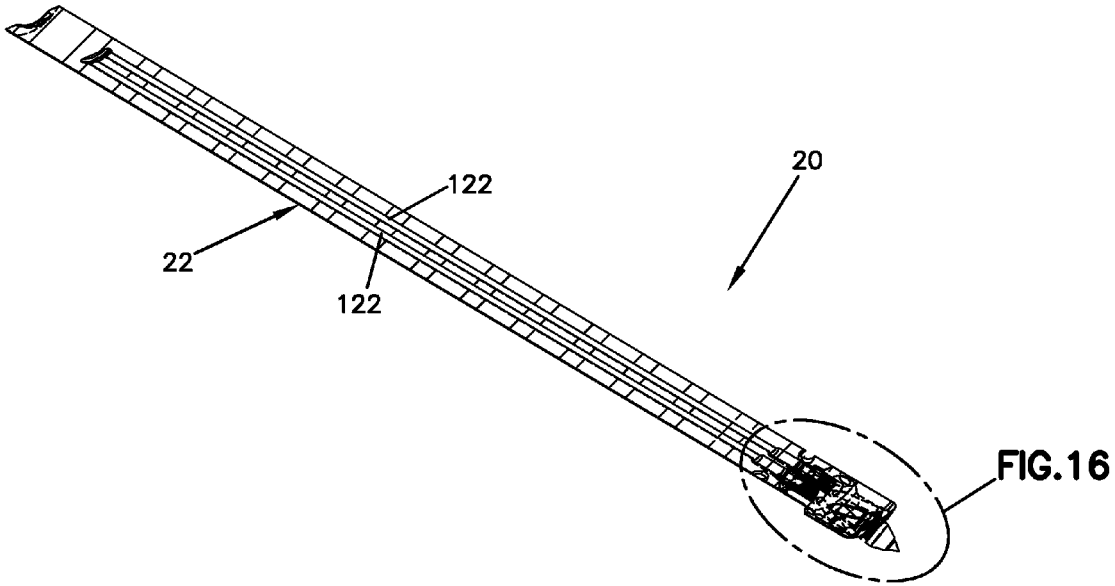
FIG. 15 is a cross-sectional view taken along section line 15-15 of FIG. 14.

Referring to FIGS. 1-3, the sonde housing 22 has an elongated body 32 having a length that extends along a central longitudinal axis 34. The elongated body 32 of the sonde housing 22 can extend along the central longitudinal axis 34 from a proximal end 36 of the sonde housing 22 to a distal end 38 of the sonde housing 22. The proximal end 36 of the sonde housing 22 can be adapted for connection to the drill string 30. In one example, the sonde housing 22 can define an elongate sonde compartment 40 (see FIG. 1) having a length that extends along the central longitudinal axis 34 of the sonde housing 22. The sonde compartment 40 can have an open top side 42 that can be covered by a removable cover member 44. The removable cover member 44 can include a proximal tab 46 and a distal tab 48. When the removable cover member 44 is mounted over the sonde compartment 40, the proximal tab 46 fits within a notch 50 (see FIG. 13) of the sonde housing 22 and the distal tab 48 is captured underneath a rear portion of the rotary cutting tool 24.

Referring again to FIG. 1, the removable cover member 44 can be secured to the sonde compartment 40 by placing a plug 52 through a hole 54 defined by the removable cover member 44 such that the plug 52 can be received through a distal portion 56 of the sonde compartment 40 when the removable cover member 44 is mounted to the sonde compartment 40. The plug 52 can be positioned adjacent to the distal tab 48. The plug 52 can have a groove 58 therein for receiving a cross-member 60. In one example, the groove 58 can have an open sided configuration with an open side position adjacent to the distal end 38 of the sonde housing 22.

In one example, the cross-member 60 (e.g., a roll pin) can engage the groove 58 of the plug 52 so as to prevent the removable cover member 44 from sliding in a distal direction D when the cross-member 60 is in place. A cross-opening 65 can receive the cross-member 60 and by inserting the cross-member 60 within the cross-opening 65, the cross-member 60 and the groove 58 prevent the proximal tab 46 from disengaging from the notch 50. After the cross-member 60 is inserted within the cross-opening 65, a redundant fastener 62 (e.g., a cap screw) can be secured (e.g., threaded into) at a location immediately distal to the distal tab 48 to also prevent the removable cover member 44 from sliding in the distal direction D. An opening 114 in the rotary cutting tool 24 allows the fastener 62 to be accessed when the rotary cutting tool 24 has been secured to the sonde housing 22.

To remove the removable cover member 44 from the sonde housing 22, the cross-member 60 is removed by punching the cross-member 60 transversely from the sonde housing 22 out of the cross-opening 65 and the redundant fastener 62 can be removed by unthreading the redundant fastener 62 from the sonde housing 22. With the cross-member 60 and the redundant fastener 62 removed, the removable cover member 44 can be slid in the distal direction D to disengage the proximal tab 46 from the notch 50. Thereafter, the proximal end of the removable cover member 44 and the distal tab 48 can be slid out from beneath the rear portion of the rotary cutting tool 24.

Figure 4:
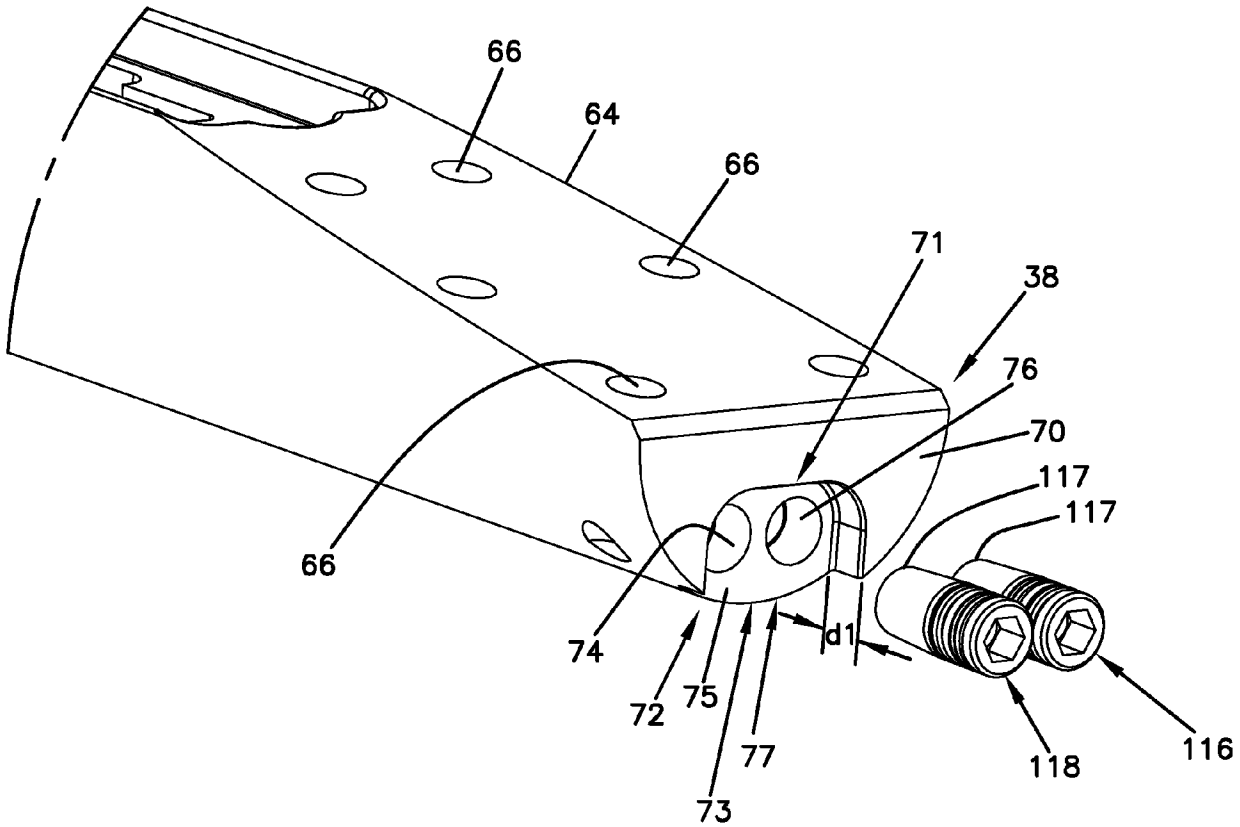
FIG. 4 is a partial perspective view of the sonde housing of FIG. 1.

Referring to FIG. 4, the sonde housing 22 can include a first angled face 64 that is angled relative to the central longitudinal axis 34 and that converges toward the central longitudinal axis 34 as the first angled face 64 extends toward the distal end 38 of the sonde housing 22. The first angled face 64 of the sonde housing 22 can define a plurality of internally threaded apertures 66 for receiving fasteners 68 (see FIG. 1) therein. The distal end 38 of the sonde housing 22 can include a distal face 70 (e.g., perpendicular face) that may be generally perpendicular to the central longitudinal axis 34 of the sonde housing 22. The distal face 70 can define a recess portion 72 (e.g., mounting aperture) that defines a first opening 74 and a second opening 76 extending into the sonde housing 22. In this example, the first and second openings 74, 76 (i.e. first and second pin mount openings) can extend from the distal face 70 proximally into the sonde housing 22. The first and second openings 74, 76 can have central axes that extend along the central longitudinal axis 34 of the sonde housing 22.

The recess portion 72 of the sonde housing 22 can have a distal end 71, a proximal end 73, and a depth d1 (e.g., mounting depth) that extends between the distal and proximal ends 71, 73. The distal end 71 of the recess portion 72 may have an opening and the proximal end 73 may be defined at least in part by a recess end surface 75 that faces in the distal direction D. In the example shown, the recess portion 72 of the sonde housing 22 has an open side 77 that extends between the distal and proximal ends 71, 73 of the recess portion 72. In certain examples, the recess portion 72 can be fully enclosed around its perimeter so that no open sides are provided.

Figure 5:
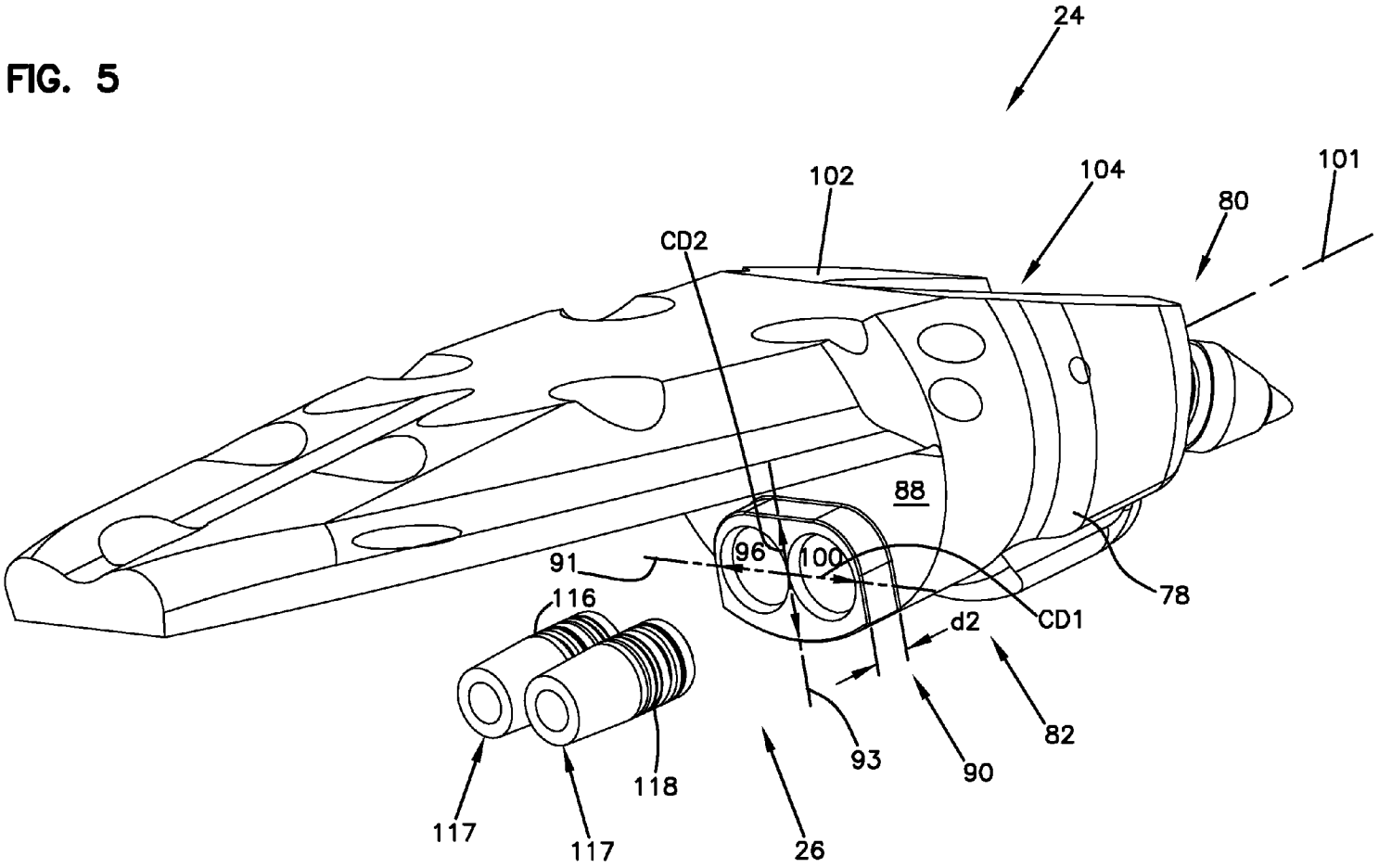
FIG. 5 is a perspective view of the rotary cutting tool of FIG. 1.
Figure 6:
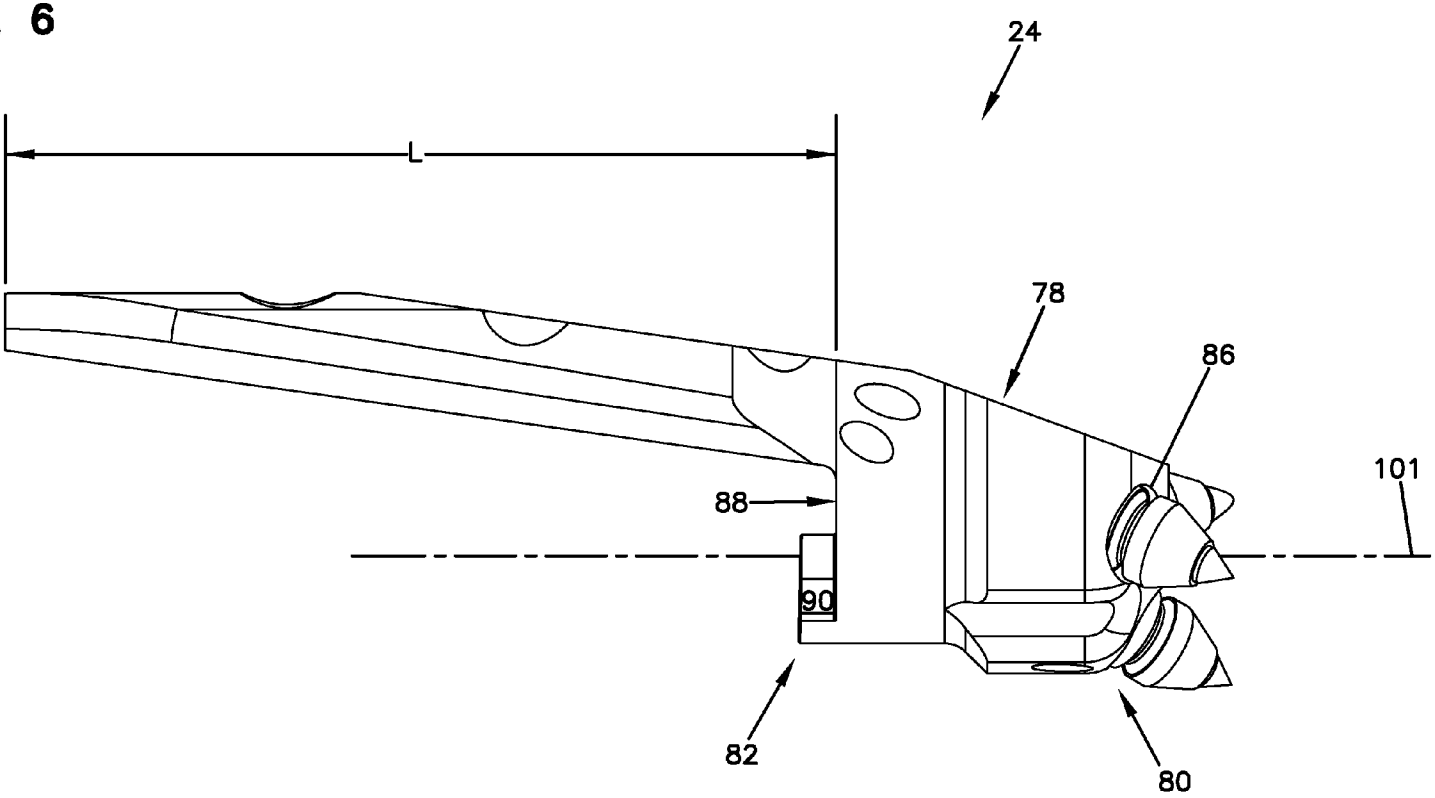
FIG. 6 is a side view of the rotary cutting tool of FIG. 5.

Referring to FIGS. 5-6, the rotary cutting tool 24 defining the mounting block 90 is illustrated in more detail. The rotary cutting tool 24 can be mounted to the distal end 38 of the sonde housing 22. The rotary cutting tool 24 can include a main body 78 that has a distal side 80 and a proximal side 82. The main body 78 can extend along an axis of rotation 101 of the rotary cutting tool 24 between the proximal side 82 of the main body 78 and the distal side 80 of the main body 78. The axis of rotation 101 of the rotary cutting tool 24 is the axis that the rotary cutting tool 24 rotates about during drilling. The distal side 80 can include a distal face 84 in which a plurality of cutting teeth pockets 86 are defined. The proximal side 82 can include a proximal face 88 (e.g., proximally directed face) at the proximal side 82 of the main body 78 that faces in a proximal direction. The proximal face 88 can be arranged and configured to oppose the distal face 70 of the sonde housing 22.

Figure 7:
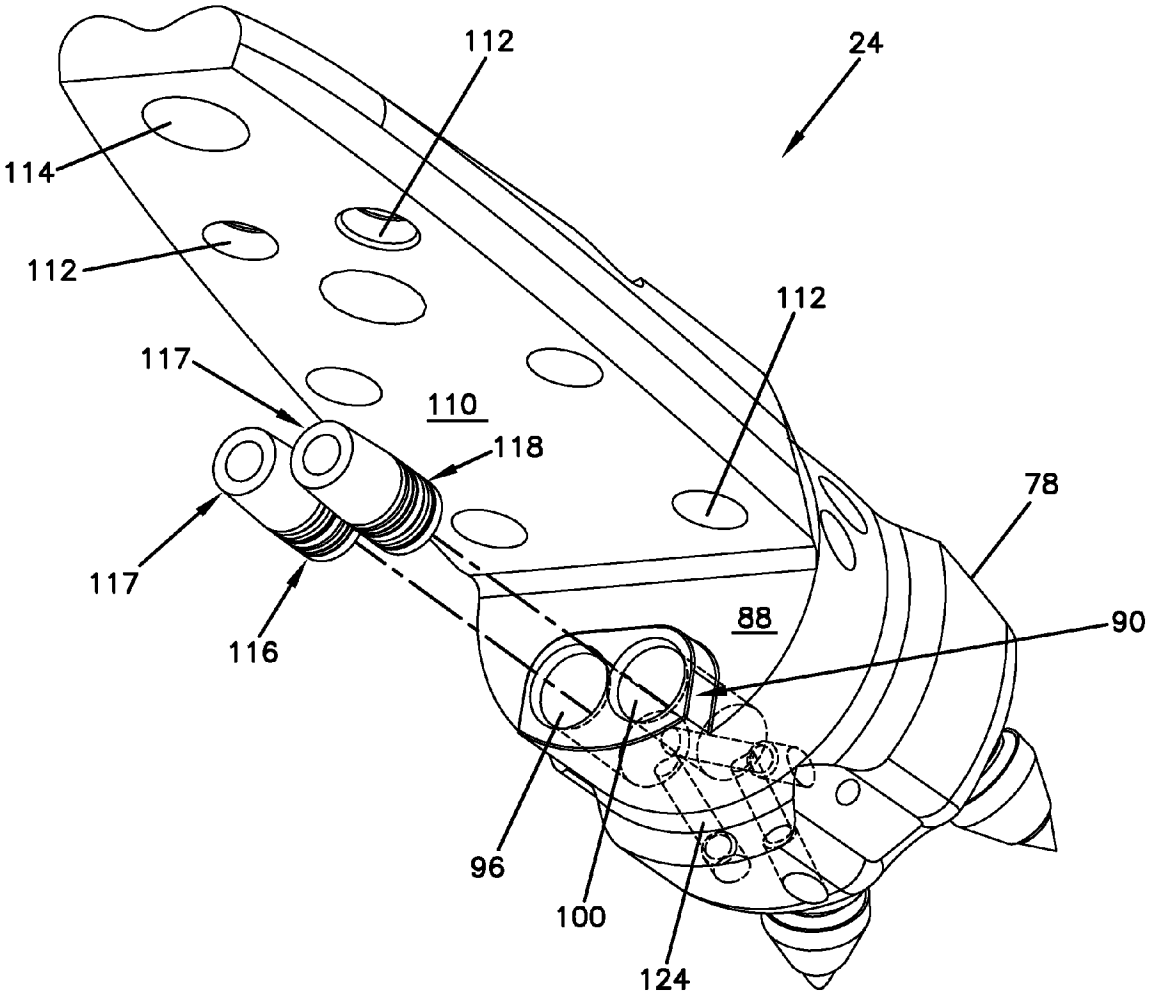
FIG. 7 is a bottom perspective view of the rotary cutting tool of FIG. 5.
Figure 8:
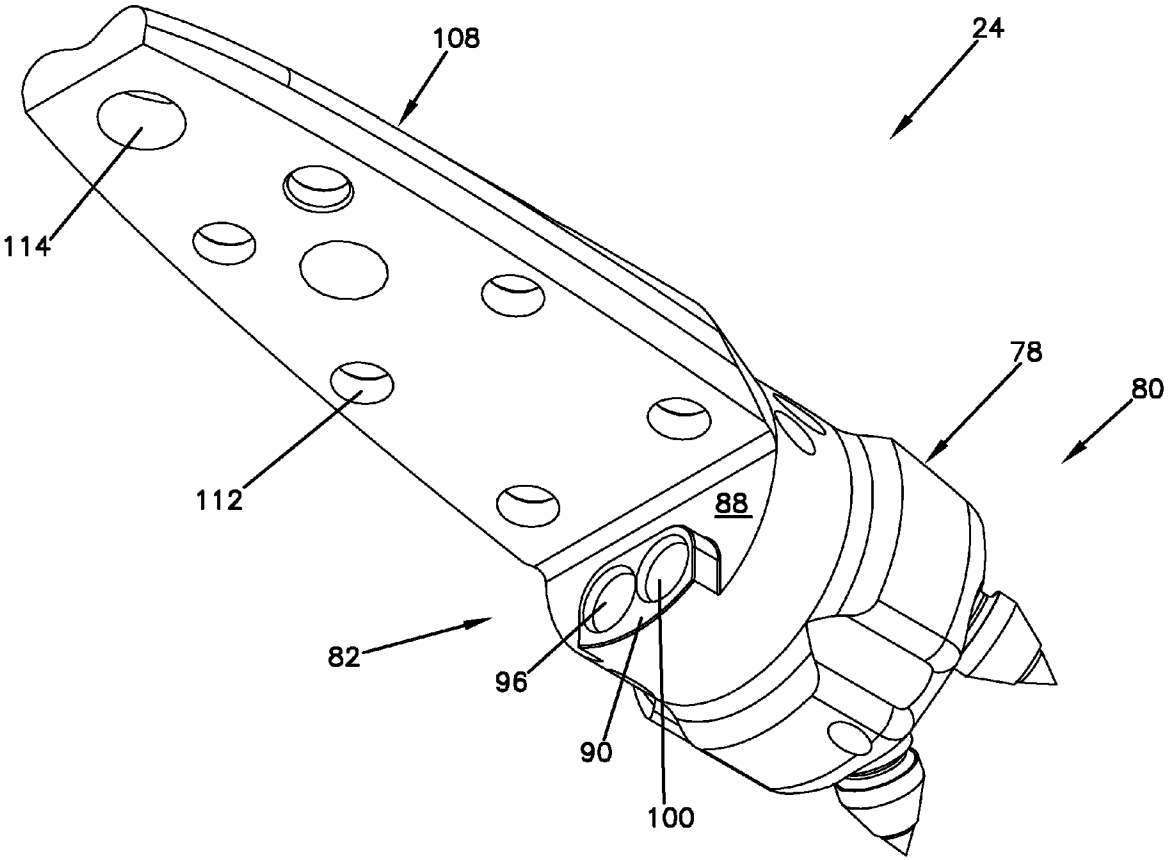
FIG. 8 is another bottom perspective view of the rotary cutting tool of FIG. 5.
Figure 9:
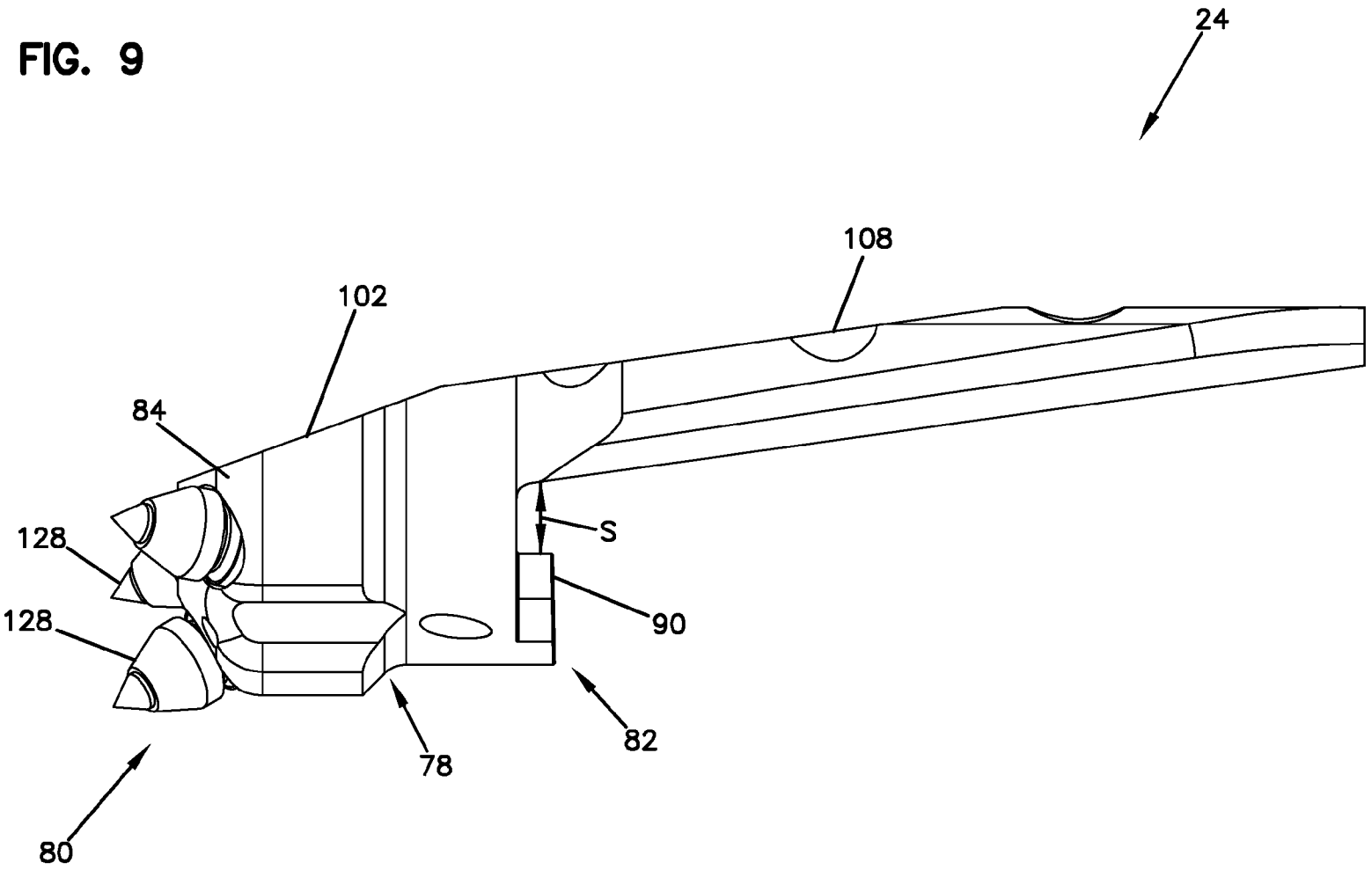
FIG. 9 is an opposite side view of the rotary cutting tool of FIG. 6.
Figure 10:
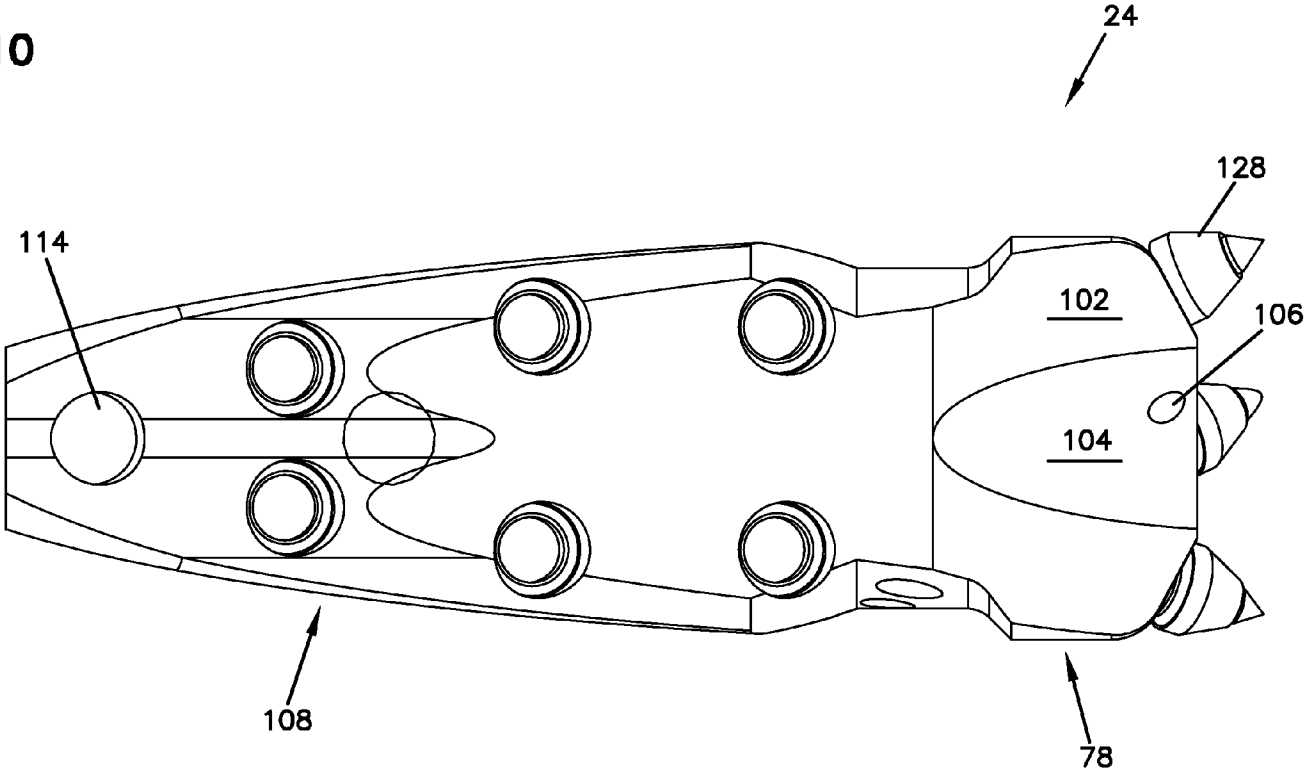
FIG. 10 is a top view of the rotary cutting tool of FIG. 5.
Figure 11:
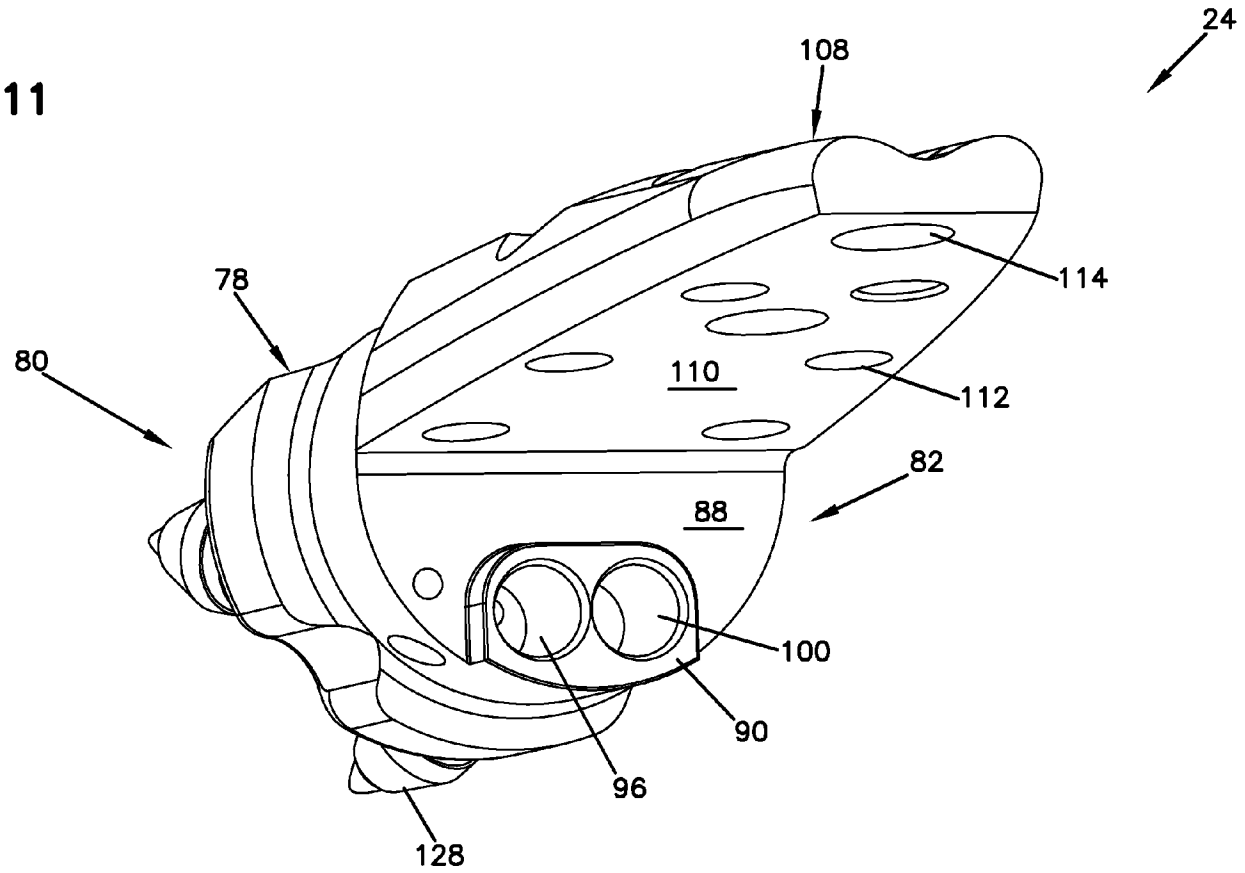
FIG. 11 is proximal side perspective view of the rotary cutting tool of FIG. 5.
Figure 12:
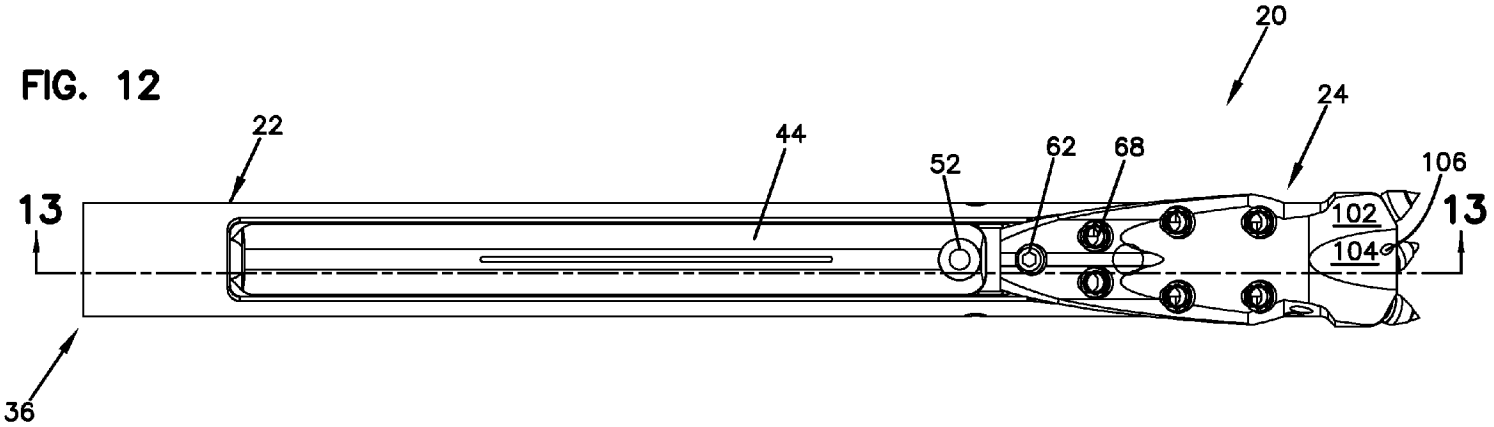
FIG. 12 is a top view of the sonde housing and the rotary cutting tool of FIG. 1 with the rotary cutting tool coupled to the sonde housing.

Referring to FIG. 7, the proximal face 88 can be integrated with or coupled to a block element 90 (e.g., mounting protrusion). The block element 90 projects proximally from the proximal face 88 of the main body 78. The block element 90 can be defined as being formed from one unitary piece with the main body 78 of the rotary cutting tool 24. In other examples, the block element 90 can be coupled to the main body 78 of the rotary cutting tool 24 by other means such as fasteners or a weld mount. The rotary cutting tool 24 may define a first pin opening 96 and a second pin opening 100 that extend through the block element 90 in a proximal-to-distal direction. The first and second pin openings 96, 100 (i.e., first and second pin sockets) also extend distally past the proximal face 88 distally into the main body 78 of the rotary cutting tool 24. The first and second pin openings 96, 100 can be arranged and configured to respectively co-axially align with the first and second openings 74, 76 of the sonde housing 22.

Referring to FIGS. 8-11, the main body 78 of the rotary cutting tool 24 can define a second angled face or angled steering face 102 (i.e., a ramp surface) that faces at least partially in the distal direction and angles toward the central longitudinal axis 34 as the second angled face 102 extends in the distal direction D. In other examples, second angled face 102 can be angled toward the axis of rotation 101 as the second angled face 102 extends in the distal direction D along the axis of rotation 101. The second angled face 102 can be used to facilitate steering of the drilling apparatus 20. A recess area 104 can be defined within the second angled face 102 where the recess area 104 defines discharge ports 106 for fluids to pass therethrough. The distal face 84 may be generally perpendicular to the central longitudinal axis 34.

In certain examples, the rotary cutting tool 24 can include the proximal face 88 located between the distal and proximal sides 80, 82 and oriented approximately perpendicular to the axis of rotation 101. The second angled mounting face 102 can extend between the proximal face 88 and the proximal side 82.

In one example, the rotary cutting tool 24 can include a proximal tail or extension 108 that extends proximally from the proximal face 88 of the main body 78 of the rotary cutting tool 24. The proximal extension 108 can have a bottom surface 110 that opposes the first angled face 64 of the sonde housing 22 such that the plurality of apertures 66 located in the first angled face 64 align with apertures 112 located in the proximal extension 108 when the rotary cutting tool 24 is coupled to the sonde housing 22. Then as described above, the redundant fastener 62 (e.g., a cap screw) can be inserted through the opening 114 in the rotary cutting tool 24 and threaded into the sonde housing 22 to help prevent the removable cover member 44 from sliding in the distal direction D. Fasteners 68 can be inserted through the apertures 112 and threaded into the plurality of apertures 66 to secure the rotary cutting tool 24 to the sonde housing 22.

In certain examples, the block element 90 can be separated from the proximal extension 108 by a spacing S (see FIG. 9) such that the axis of rotation 101 extends through the spacing S and the block element 90 can be offset from the axis of rotation 101. In other examples, the recess portion 72 can be offset from the axis of rotation 101. In some examples, the proximal extension 108 can have a length measured in the proximal-to-distal direction.

Referring again to FIGS. 4-5, the coupling interface 26 can include the block element 90 having a pin-and-socket arrangement with a first pin 116 and a second pin 118 that can be slid into the first and second pin openings 96, 100 of the rotary cutting tool 24 when the rotary cutting tool 24 is mated with the sonde housing 22. The first and second pins 116, 118 can be secured to (e.g., threaded into) corresponding first and second openings 74, 76 of the sonde housing 22. In other examples, the first and second pins 116, 118 can be secured to (e.g., threaded into) the first and second pin openings 96, 100 of the rotary cutting tool 24 and slid into the first and second openings 74, 76 of the sonde housing 22. In some examples, one of the first or second pins 116, 118 can be secured to (e.g., threaded into) the sonde housing 22 and the other of the first or second pins 116, 118 can be secured to (e.g., threaded into) the rotary cutting tool 24.

Figure 4A:
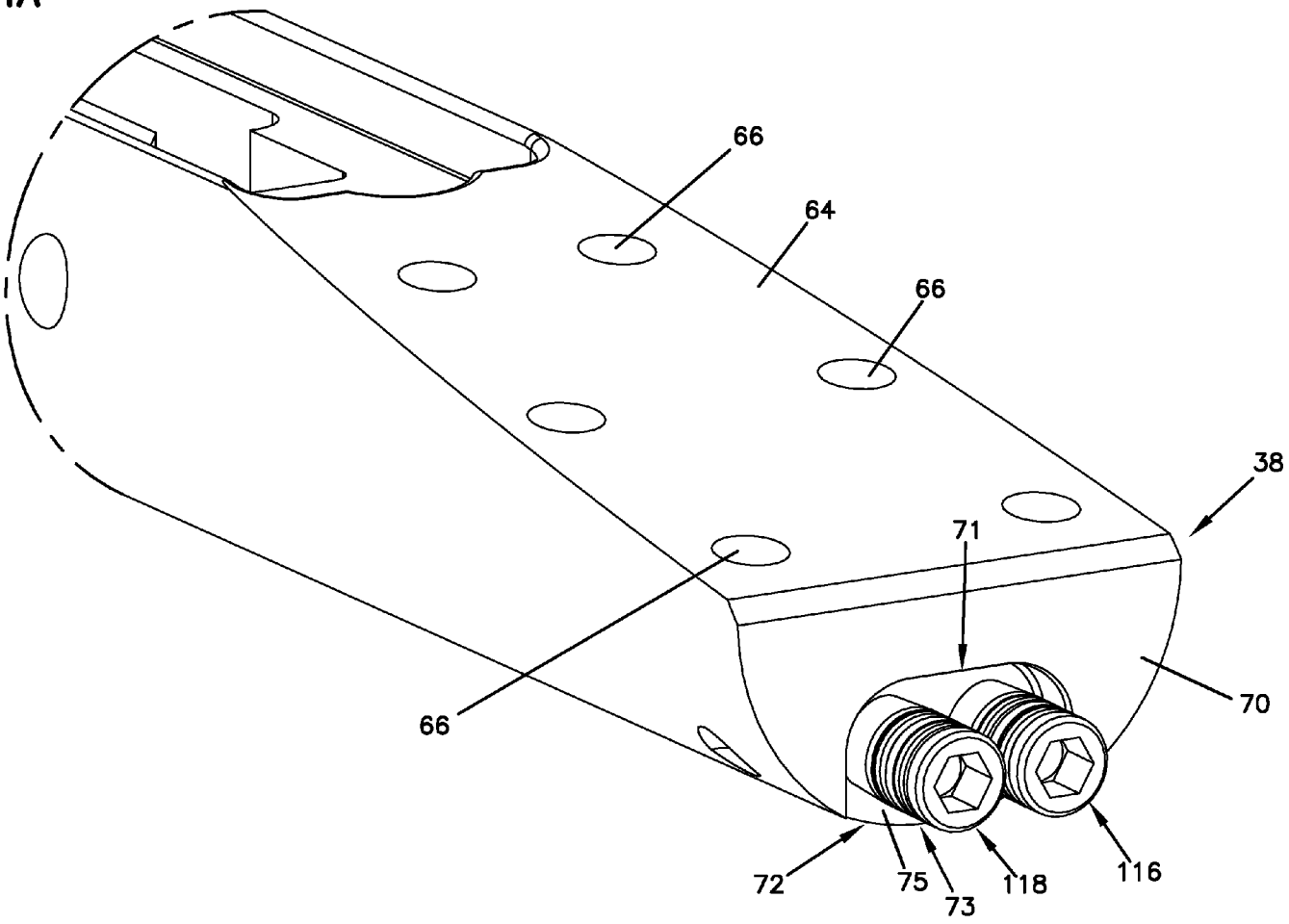
FIG. 4A is a partial perspective view of the sonde housing of FIG. 1 with first and second pins connected to the sonde housing.

In one example, the first and second pins 116, 118 can be integral (e.g., one-piece unit) with the sonde housing 22. In certain examples, the first and second pins 116, 118 can be integral (e.g., one-piece unit) with the rotary cutting tool 24. In other words, the first and second pins 116, 118 can be carried with either the sonde housing 22 or the rotary cutting tool 24. FIG. 4A shows the first and second pins 116, 118 connected to the sonde housing 22.

In certain examples, a single pin may be used to secure the rotary cutting tool 24 and the sonde housing 22 together. The block element 90 can define at least one pin socket that extends through the depth d2 of the block element 90. The sonde housing 22 can define at least one opening that extends in an orientation that extends along the depth d1. It is understood that the single pin can be either threaded or slid into the block element 90 or the sonde housing 22.

In certain examples, the block element 90 and the recess portion 72 can be reversed. In some examples, the block element 90 can be positioned on the sonde housing 22 and the recess portion 72 can be defined by the rotary cutting tool 24. In other words, the block element 90 or the recess portion 72 can be provided at the proximal face 88 of the rotary cutting tool 24. In other examples, either the block element 90 or the recess portion 72 can be provided at the distal face 70 of the sonde housing 22. The distal side 80 of the rotary cutting tool 24 can include a feature that is configured for at least one of cutting and grinding.

In other examples, the first angled face 64 of the sonde housing 22 and the bottom surface 110 of the proximal extension 108 can slide axial together when the sonde housing 22 and the rotary cutting tool 24 are coupled together. Fasteners 68 (e.g., a cap screw) can be threaded within the plurality of apertures 66 located in the sonde housing 22 and through the apertures 112 located in the proximal extension 108 to couple the sonde housing 22 and the rotary cutting tool 24 together. In certain examples, the proximal extension 108 and the block element 90 can be unitarily formed with the main body 78 of the rotary cutting tool 24.

In one example, the recess portion 72 of the distal face 70 of the sonde housing 22 can be arranged and configured to receive the block element 90 integrated with or coupled to the proximal face 88 of the rotary cutting tool 24 such that the first and second pins 116, 118 extending from the sonde housing 22 can be inserted into the first and second pin openings 96, 100 of the rotary cutting tool 24. The block element 90 of the coupling interface 26 can have a configuration that corresponds to the recess portion 72 of the distal face 70 of the sonde housing 22 to allow the block element 90 to be inserted within the recess portion 72 when the first and second pins 116, 118 are received within the first and second pin openings 96, 100. The block element 90 can be inserted in the recess portion 72 in an insertion direction ID that extends along the central longitudinal axis 34 of the sonde housing 22 when the sonde housing 22 and the rotary cutting tool 24 are coupled together. The block element 90 can have a perimeter shape that matches or complements a perimeter shape of the recess portion 72. In some examples, the block element 90 can have rounded corners. It is to be understood that the block element 90 can have other shaped corners (e.g., non-round). In certain examples, when the block element 90 is mated with the recess portion 72, torque and shear can be transferred between the rotary cutting tool 24 and the sonde housing 22 through the mated interface between the block element 90 and the recess portion 72. Thus, the mated interface provided by the block element 90 and the recess portion 72 cooperates with the pin-and-socket coupling provided by the first and second pins 116, 118 and the first and second openings 74, 76 to enhance the shear and torque capacity provided at the interface between the rotary cutting tool 24 and the sonde housing 22.

The mating relationship between the recess portion 72 and the block element 90 can allow torque and shear to be transferred between the parts. In one example, the mating interface can be offset from the axis of rotation 101 such that torque will be transferred regardless of the shape of the mating parts. In another example, the mating interface can be centered on the axis of rotation 101. In such configuration, it would be advantageous to use a non-circular mating interface shape to promote the transfer of torque. In certain examples, the elongated configuration of the block element 90 can allow it to accommodate two pins and also provide a significant amount of material for transferring torque and/or resisting shear.

In other examples, the block element 90 or the recess portion 72 can include a first cross-dimension CD1 that extends along a major axis 91 of the block element, a second cross-dimension CD2 that extends along a minor axis 93 of the block element, and a depth d2 (e.g., mounting depth) that extends along the axis of rotation 101.

In certain examples, the major and minor axes 91, 93 can be perpendicular to the depths d1, d2. The major and minor axes 91, 93 can be perpendicular to relative to each other and the first cross-dimension CD1 can be longer than the second cross-dimension CD2. In some examples, the minor axis 93 can extend in a radial direction relative to the axis of rotation 101. In certain examples, the depth d2 can be at least 10 percent as long as the second cross-dimension CD2. In other examples, the depth d2 can be at least 20 percent as long as the second cross-dimension CD2.

In some examples, the first cross-dimension CD1 can be at least 1.5 times as long as the second cross-dimension CD2. In still other examples, the second cross-dimension CD2 can be longer than the depth d2. In some examples, the second cross-dimension CD2 can be at least twice as long as the depth d2. In other examples, the second cross-dimension CD2 can be at least three times as long as the depth d2. In certain examples, the first cross-dimension CD1 can be at least 25 percent as long as a cutting diameter of the rotary cutting tool 24. In some examples, the proximal extension 108 can have a length L (see FIG. 6) measured at least 5 times as long as the depth d2 of the block element 90. In other examples, the proximal extension 108 can be a length L of at least 10 times as long as the depth d2 of the block element 90.

Referring to FIGS. 12-15, for most drilling applications it is desirable to provide drilling fluid to the rotary cutting tool 24 during drilling. Typically, drilling fluid can be pumped down the drill string 30 into the rotary cutting tool 24 and discharged through discharge ports 97. The sonde housing 22 can be adapted to receive drilling fluid through the socket 120 at the proximal end 36 of the sonde housing 22. From the socket 120, the drilling fluid can travel through two separate, parallel passages 122 that extend from the socket 120 to the first and second openings 74, 76. The first and second pins 116, 118 can be hollow to provide for fluid communication between fluid passages of the sonde housing 22 and fluid passages of the rotary cutting tool 24.

Figure 16:
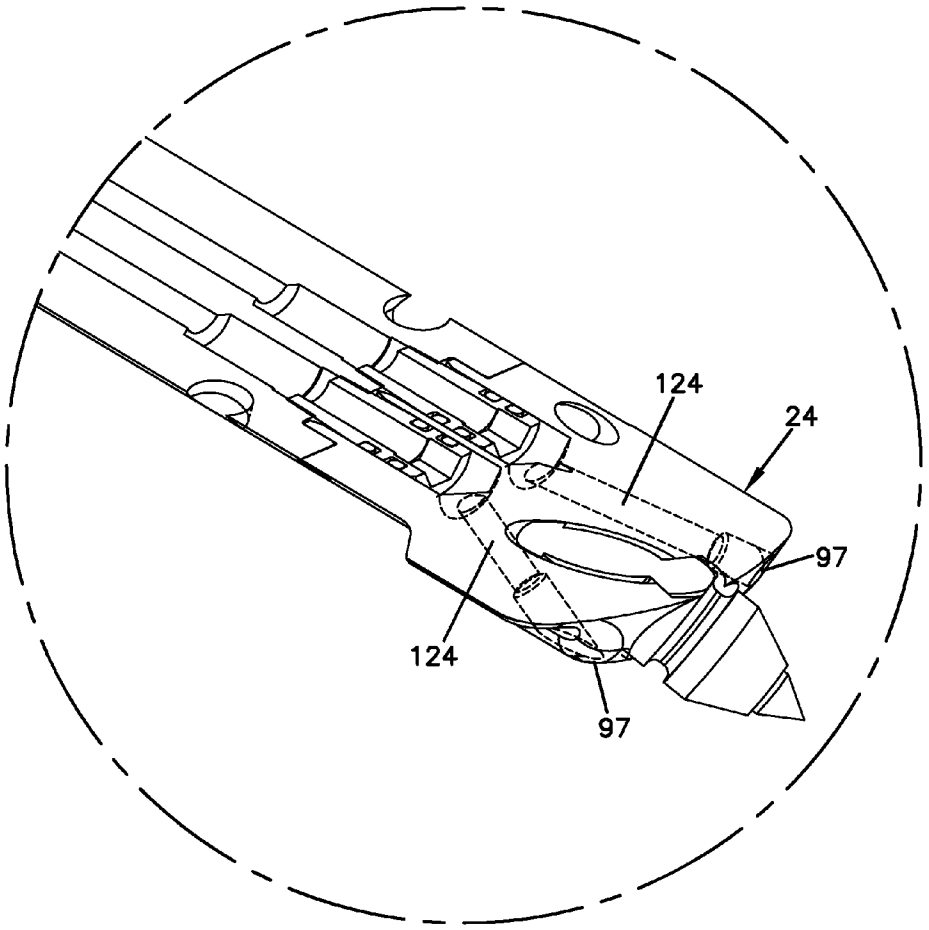
FIG. 16 is an enlarged view of the rotary cutting tool shown in FIG. 15.

Referring to FIG. 16, from the first and second openings 74, 76 the fluid flows through the first and second pins 116, 118 to distal passages 124 extending through the main body 78 of the rotary cutting tool 24. The distal passages 124 can extend from their respective pins 116, 118 to discharge ports 97 defined by the recess area 104 of the second angled face 102. Advantageously, the arrangement utilizes two separate passages and/or flow lines that extend separately from the socket 120 at the proximal end 36 of the sonde housing 22 to the discharge ports 97. By having two separate fluid lines extending substantially the entire length of the drilling apparatus 20, one is always available in the event the other becomes plugged. Moreover, the generally straight paths of the fluid lines reduce the likelihood of plugging.

It will be appreciated that the sonde housing 22 can be configured for holding a sonde used to monitor operational parameters of the rotary drilling tool such as pitch and rotational orientation (i.e., roll position or clock position). The sonde can be secured in a compartment of the sonde housing at a fixed position relative to the first angled face 64 and the recess portion 72. The sonde housing 22 can be configured to allow side loading of the sonde, end loading of the sonde or other loading configurations. Further details about an example sonde are disclosed at U.S. Pat. No. 7,172,035, which was previously incorporated by reference herein.

The proximal end 36 of the sonde housing 22 is adapted for connection to the distal end 28 of the drill string 30. For example, as shown at FIGS. 1-2, the proximal end 36 of the sonde housing 22 comprises a female end having a socket 120 with internal threads 121 and the distal end 28 of the drill string 30 comprises a male end having a shank 126 with external threads. In this way, the distal end 28 of the drill string 30 can be readily threaded into the proximal end 36 of the sonde housing 22.

The first and second pins 116, 118 of the coupling interface 26 are preferably secured within the first and second openings 74, 76 of the sonde housing 22. In certain examples, the first and second pins 116, 118 can be secured within the first and second pin openings 96, 100 of the rotary cutting tool 24. For example, the first and second pins 116, 118 can include threaded ends having external threads that are threaded into corresponding internal threads provided within the first and second openings 74, 76. The threaded ends of the pins 116, 118 can be fixed within the first and second openings 74, 76 and the opposite ends of the pins 116, 118 comprise free ends 117 that project distally outwardly from the proximal face of the block element 90. The free ends 117 of the first and second pins 116, 118 can be inserted into the first and second pin openings 96, 100 of the rotary cutting tool 24 to couple the rotary cutting tool 24 to the sonde housing 22. In other examples, the free ends 117 of the first and second pins 116, 118 can be inserted into the first and second openings 74, 76, of the sonde housing 22. In other examples, a single pin may be used to secure the sonde housing 22 to the rotary cutting tool 24. In some examples, one pin can be secured within the sonde housing 22 and one pin can be secured within the rotary cutting tool 24. In certain examples, the first and second pin openings 96, 100 can be aligned along the major axis 91. In other examples, the first and second pins 116, 118, can have o-ring seals about them providing circumferential seals around the first and second pins 116, 118 within first and second pin openings 96, 100.

Figure 17:
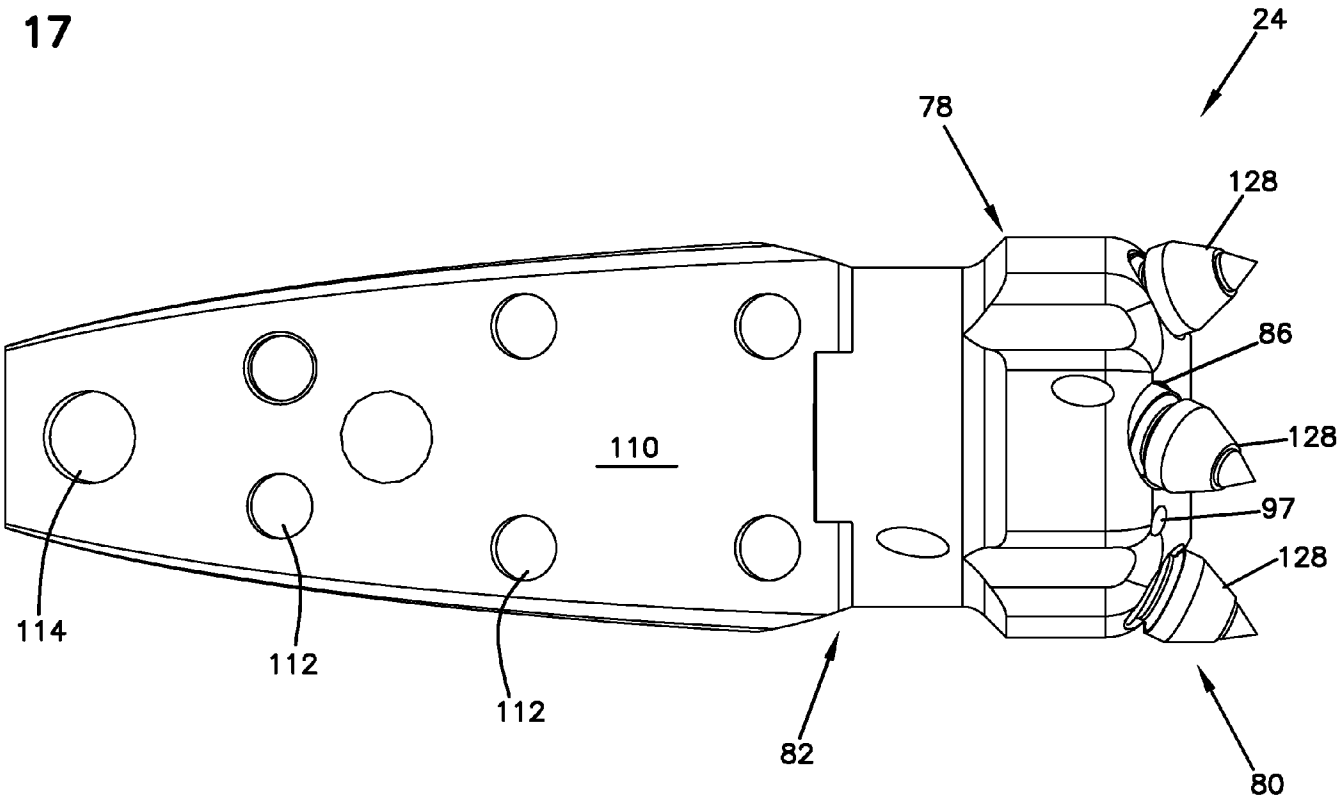
FIG. 17 is a bottom view of the rotary cutting tool of FIG. 10.
Figure 18:
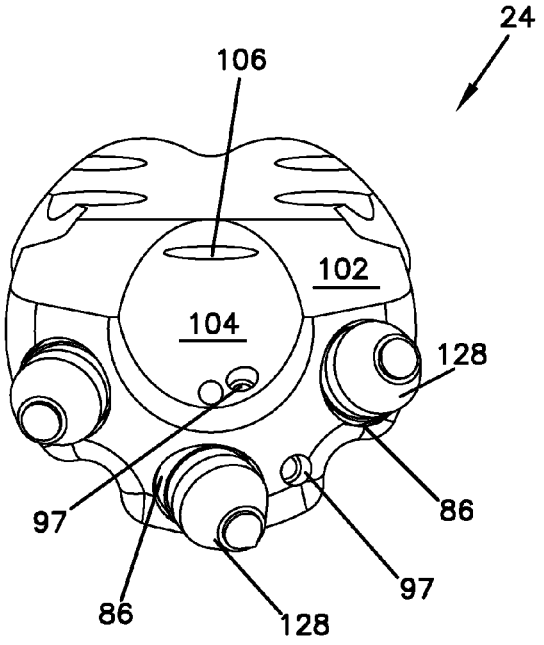
FIG. 18 is a distal end view of the rotary cutting tool of FIG. 5.
Figure 19:
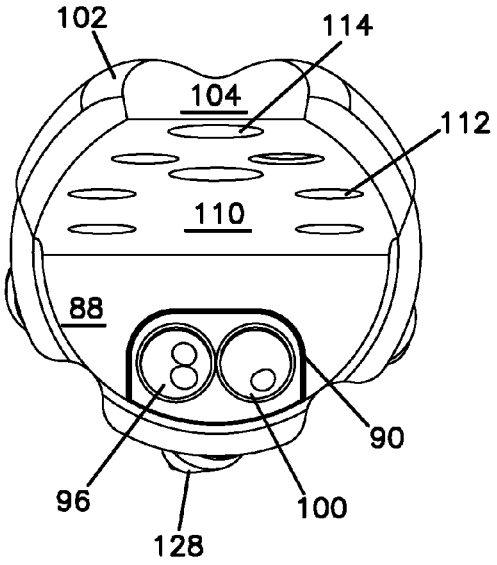
FIG. 19 is a proximal end view of the rotary cutting tool of FIG. 5.
Figure 20:
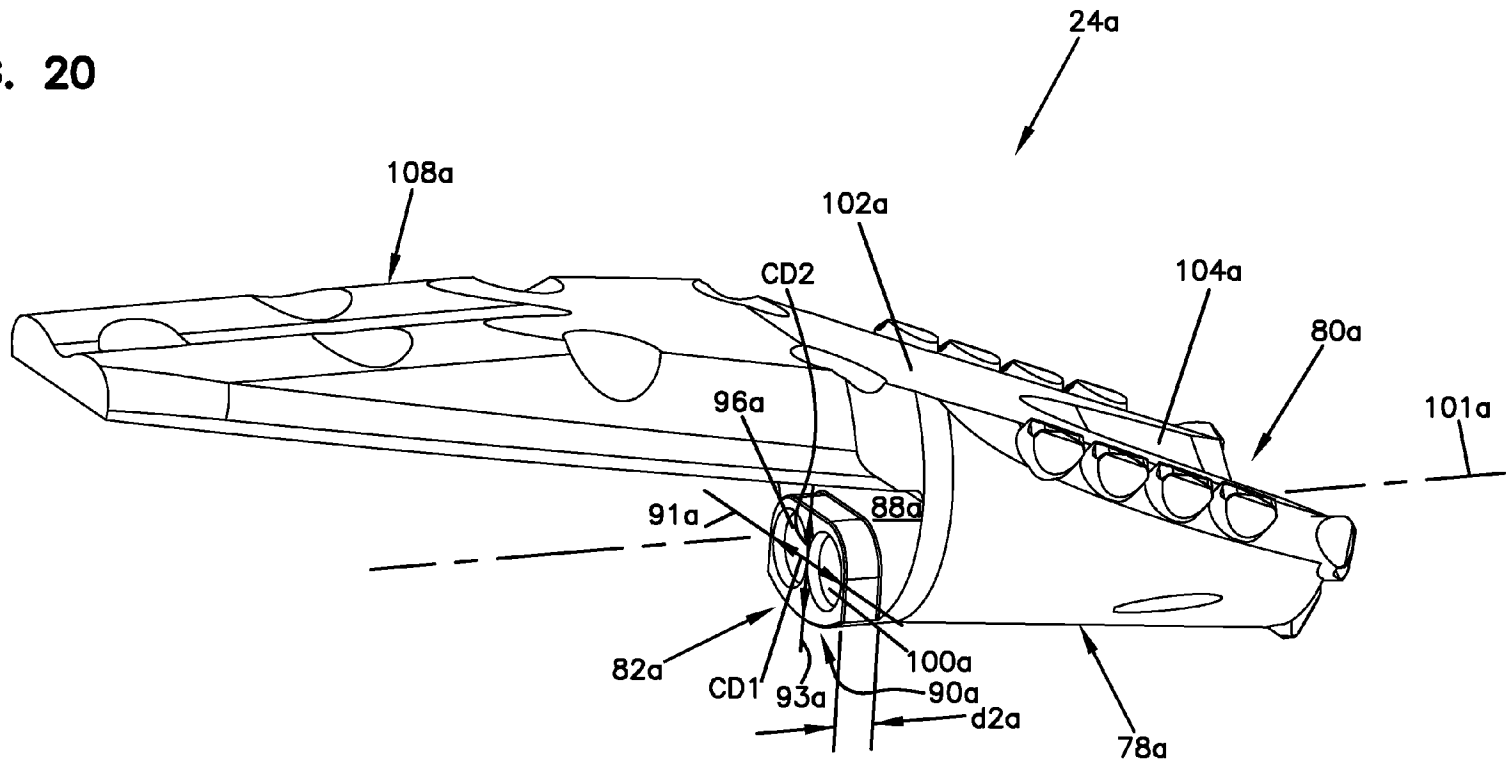
FIG. 20 illustrates another rotary cutting tool that can be interchanged with the rotary cutting tool of FIG. 1.
Figure 21:
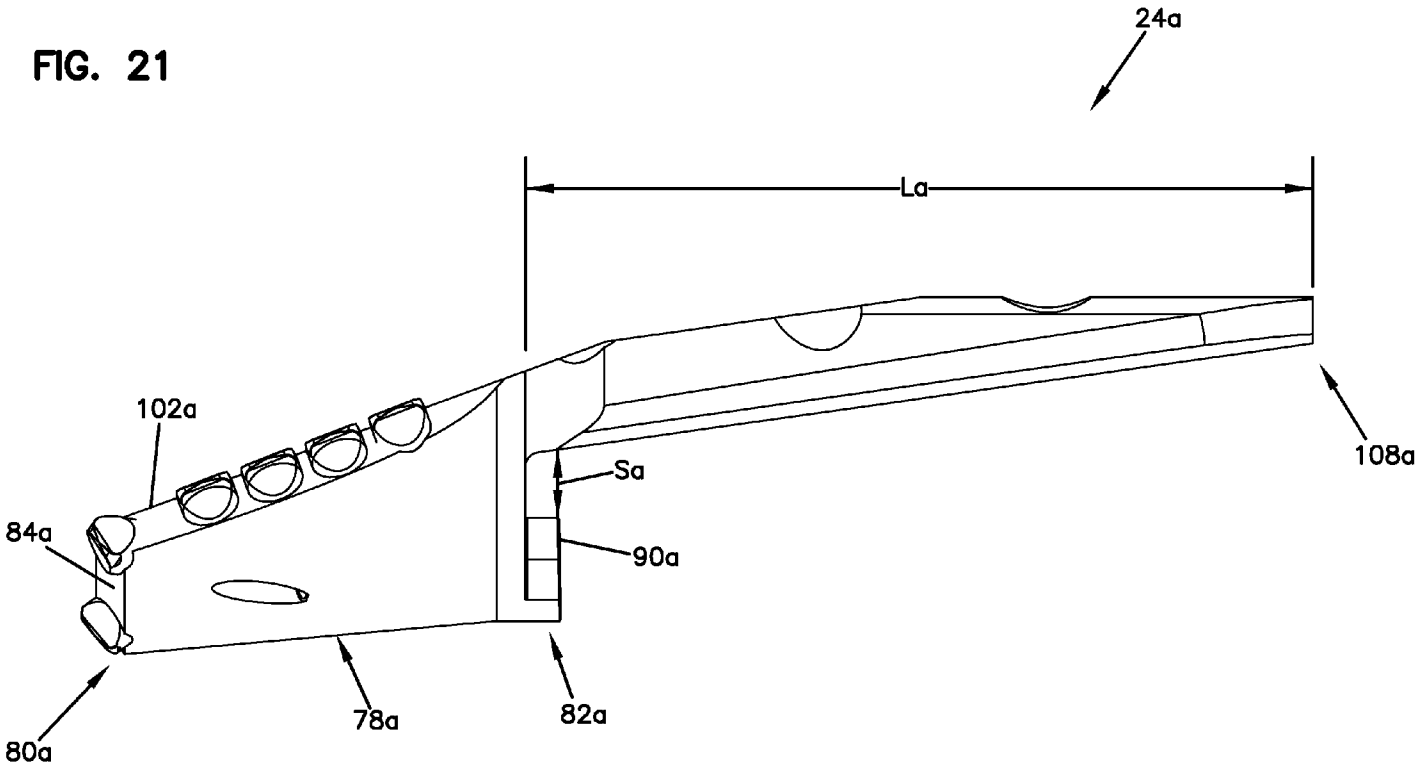
FIG. 21 is a side view of the rotary cutting tool of FIG. 20.
Figure 22:
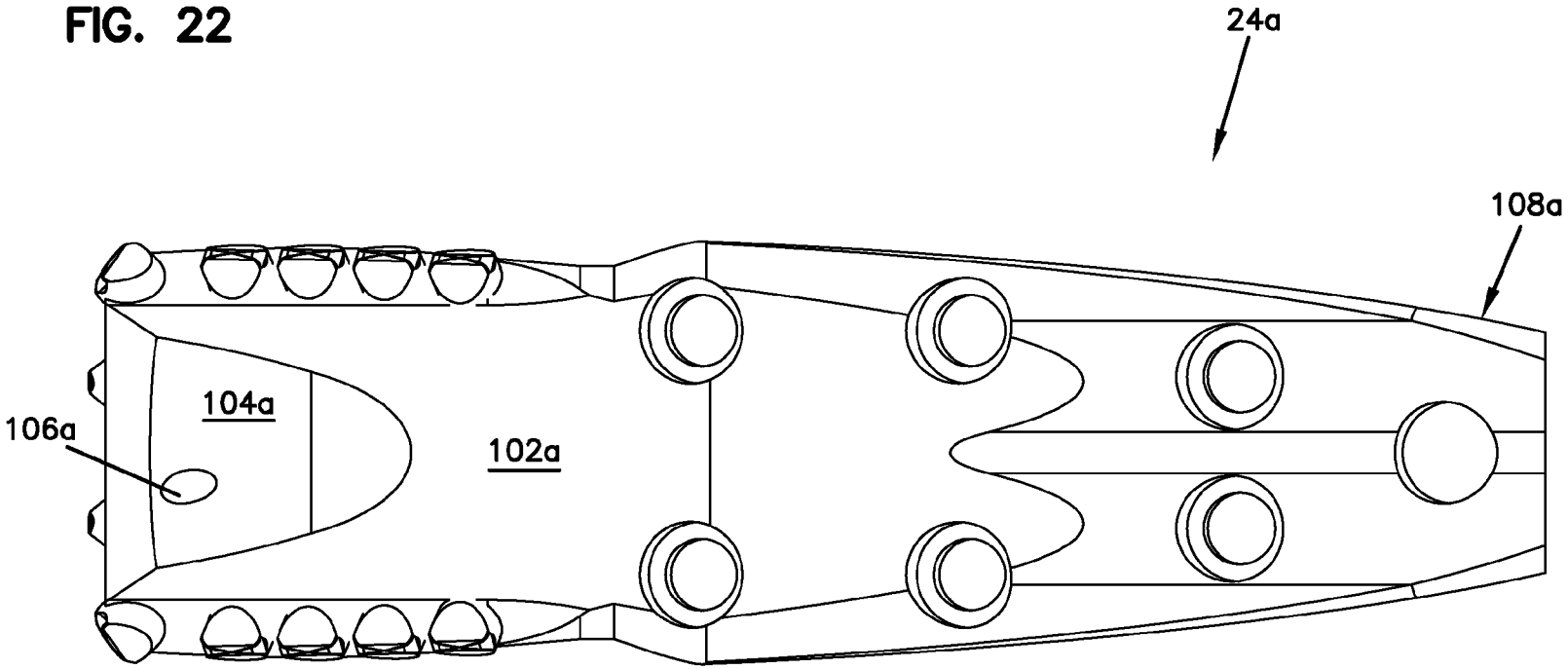
FIG. 22 is a top view of the rotary cutting tool of FIG. 20.
Figure 23:
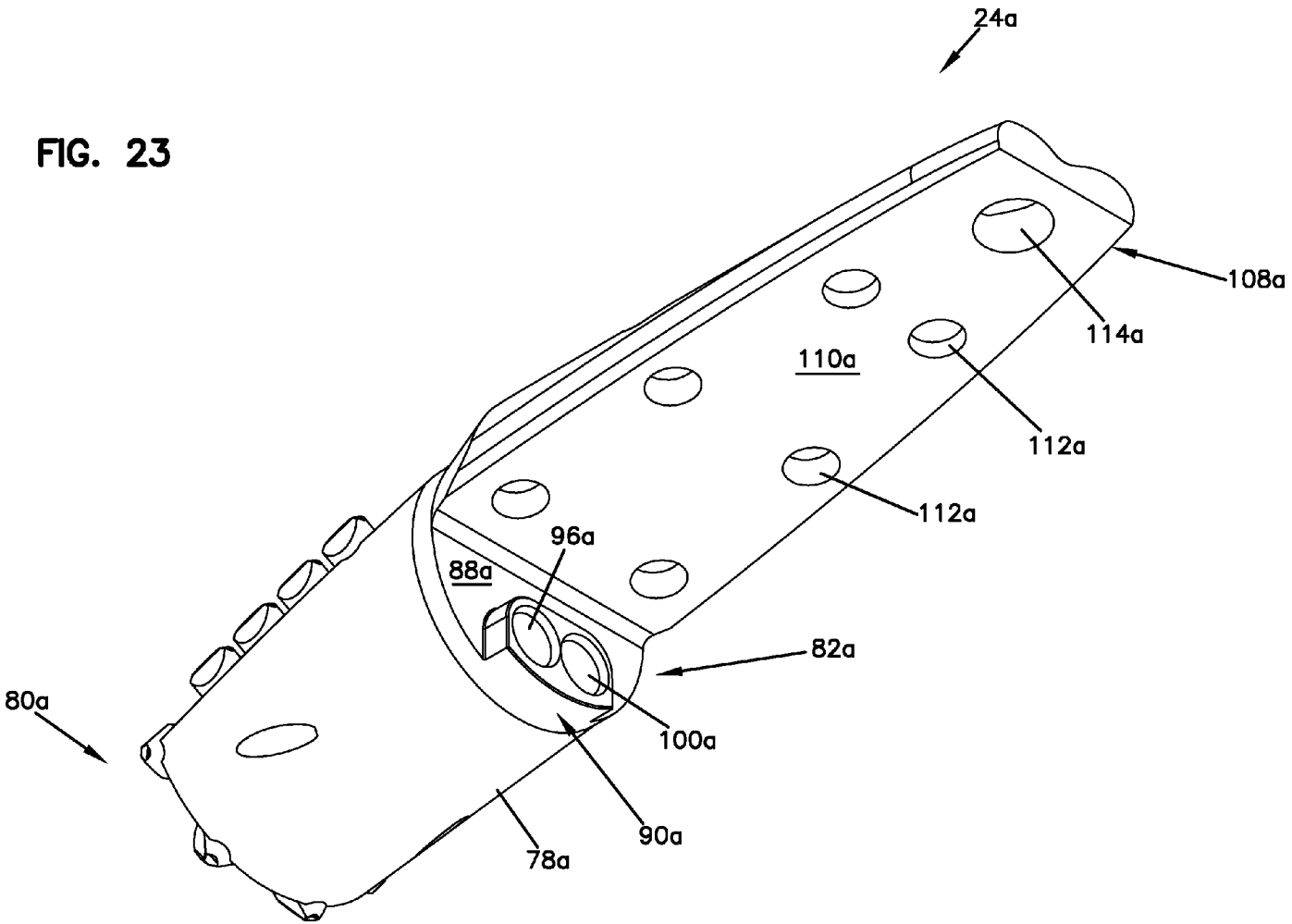
FIG. 23 is a bottom view of the rotary cutting tool of FIG. 20.
Figure 24:
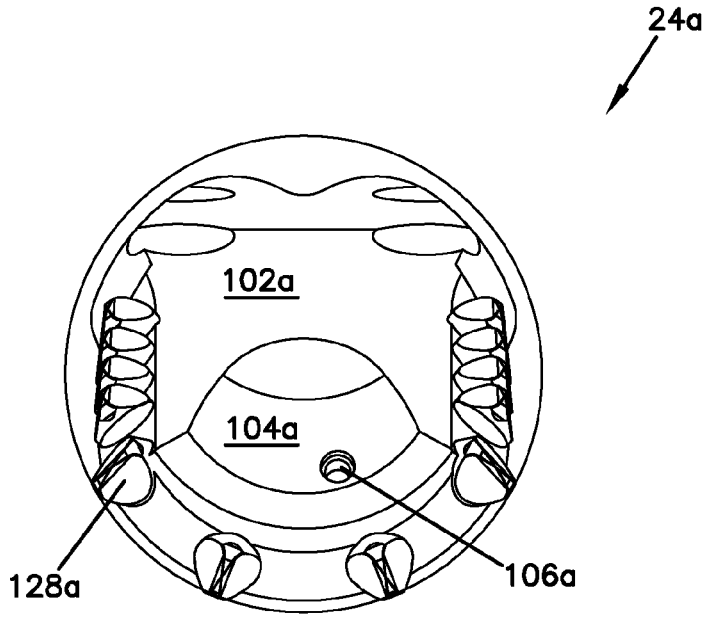
FIG. 24 is a distal end view of the rotary cutting tool of FIG. 20.
Figure 25:
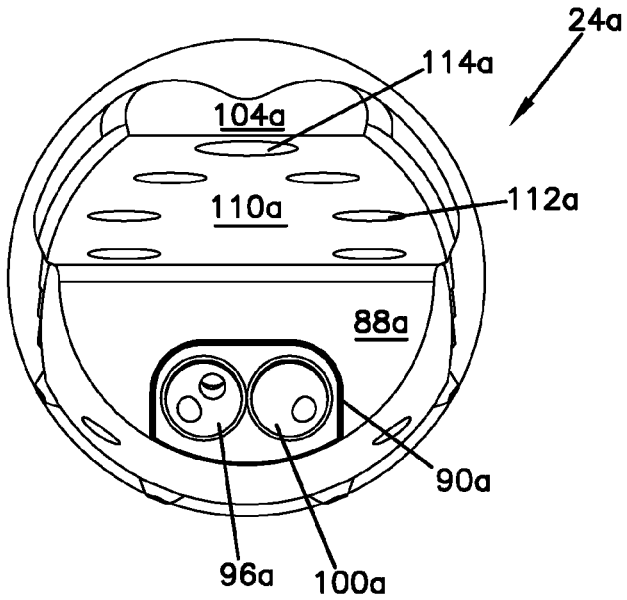
FIG. 25 is a proximal end view of the rotary cutting tool of FIG. 20.

Referring to FIGS. 17-19, the rotary cutting tool 24 of the drilling apparatus 20 comprises the main body 78 having the distal side 80 and the proximal side 82. The distal side 80 includes the distal face 84 in which a plurality of cutting teeth pockets 86 are defined. Cutting teeth 128 are mounted within the cutting teeth pockets 86. Friction rings (not shown) can be used to secure the cutting teeth 128 within the cutting teeth pockets 86. The friction rings can allow the cutting teeth 128 to rotate about their central axes during drilling operations. Rear access openings (not shown) can be provided for facilitating tapping the cutting teeth 128 from the cutting teeth pockets 86.

In one example, the rotational orientation of the rotary cutting tool 24 determines the direction in which the second angled face 102 of the rotary cutting tool 24 faces. By knowing the direction in which the second angled face 102 of the rotary cutting tool 24 faces, the operator can manipulate the rotary cutting tool 24 to steer the rotary cutting tool 24 in a desired direction (e.g., a direction opposite from the direction in which the second angled face 102 faces). Because the rotary cutting tool 24 is not threaded on the sonde housing 22 and can only be mounted in one rotational orientation due to the configuration of the coupling interface 26, the system is not required to be recalibrated each time a new cutting tool is mounted to the sonde housing 22.

It will be appreciated that other types of tools can also be mounted to the distal end 38 of the sonde housing 22 using the same coupling arrangement used to secure the rotary cutting tool 24 to the distal end 38 of the sonde housing 22. For example, FIGS. 20-25 show an alternative rotary cutting tool 24*a* that can be coupled to the sonde housing 22 using the same type of coupling interface 26 described with respect to the rotary cutting tool 24. The rotary cutting tool 24*a* can include cutting teeth 128*a* along the perimeter of the second angled face 102*a*. The rotary cutting tool 24*a* can be similar to the rotary cutting tool 24 but have different sized cutting teeth 128*a*, a different tooth pattern and a main body with a larger front concavity.

As described above, the drilling apparatus 20 can be used to drill a bore to a desired underground location. At the desired location, a pit can be excavated to access the rotary cutting tool 24 or 24*a* at the underground location. The rotary cutting tool 24 can then be removed from the sonde housing 2 and replaced with another tool (e.g., a back reamer).

For ease of explanation, various components have been described in directional terms such as "top", "bottom", "upwardly", and "downwardly" so as to provide relative frames of reference for describing the parts. These terms do not suggest that the disclosed apparatus is required to be used in a particular orientation. Quite to the contrary, during drilling operations, the drilling apparatus is rotated about a drill axis such that the directions in which the various parts of the drilling apparatus face are constantly changing. As used herein, "orifices", "sockets" and "slots" can be referred to as openings. In the depicted embodiment, the rotary cutting tool 24 is shown connected to the sonde housing 22. In alternative embodiments, the rotary cutting tool 24 can be connected to other types of drive members such as rods, stems, subs or other structures that do not contain sondes.

From the forgoing detailed description, it will be evident that modifications and variations can be made without departing from the spirit and scope of the disclosure.

The invention claimed is:

1. A drilling apparatus comprising:

a rotary cutting tool including a main body having a proximal end and a distal end and further defining a rotary axis generally extending between the proximal and distal ends, the rotary cutting tool including a proximally directed face located between the proximal and distal ends that faces mainly in a proximal direction, the rotary cutting tool also including an angled mounting face that extends between the proximally directed face and the proximal end, the angled mounting face being angled relative to the proximally directed face and the rotary axis, wherein one of a mounting aperture and a mounting protrusion are provided at the proximally directed face, the one of the mounting aperture and the mounting protrusion having a mounting depth that extends generally in the direction of the rotary axis, the one of the mounting aperture and the mounting protrusion defining a perimeter boundary shape that is longer along a major axis than a minor axis, the perimeter boundary shape being non-symmetrical about the major axis, and the perimeter boundary shape having a first portion coextensive with a perimeter outer boundary shape of the main body of the rotary cutting tool and a second portion non-coextensive with the outer boundary shape of the main body of the rotary cutting tool, the distal end including a feature that is configured for at least one of cutting and grinding.

2. The drilling apparatus of claim 1, wherein the angled mounting face defines a plurality of fastener openings.

3. The drilling apparatus of claim 1, wherein the proximally directed face of the rotary cutting tool is defined by a body of the rotary cutting tool and is substantially perpendicular relative to the rotary axis, wherein the rotary cutting tool includes a proximal tail that is integral with the body and that projects proximally from the proximally directed face of the rotary cutting tool, and wherein the angled mounting face is defined by the proximal tail of the rotary cutting tool.

4. The drilling apparatus of claim 1, wherein a fluid flow passage is defined through the one of the mounting aperture and the mounting projection.

5. The drilling apparatus of claim 3, wherein the one of the mounting protrusion and the mounting aperture are offset from the rotary axis.

6. The drilling apparatus of claim 5, wherein the major and minor axes are perpendicular relative to one another and are also perpendicular to the mounting depth, and wherein the one of the mounting protrusion and the mounting aperture defines a first cross-dimension along the major axis and a second cross-dimension along the minor axis, the first cross-dimension being longer than the second cross-dimension.

7. The drilling apparatus of claim 6, wherein the first cross-dimension is at least 1.5 times as long as the second cross-dimension, wherein the second cross-dimension is longer than the mounting depth, and wherein the mounting depth is at least 10 percent as long as the second cross-dimension.

8. The drilling apparatus of claim 6, wherein the first cross-dimension is at least 25 percent as long as a cutting diameter of the drilling tool.

9. The drilling apparatus of claim 8, wherein the proximal tail has a proximal tail length measured in the proximal-to-distal direction, and wherein the proximal tail length is at least 5 times as long as the mounting depth.

10. The drilling apparatus of claim 1, wherein the mounting protrusion is provided at the proximally directed face.

11. The drilling apparatus of claim 10, wherein the mounting protrusion defines at least one pin socket that extends through the mounting depth of the mounting protrusion.

12. The drilling apparatus of claim 10, wherein the mounting protrusion defines first and second pin sockets that extend through the mounting depth of the mounting protrusion.

13. The drilling apparatus of claim 1, further comprising a sonde housing which mates with the rotary cutting tool.

14. The drilling apparatus of claim 13, wherein the sonde housing includes a distally directed face that opposes the proximally directed face of the rotary cutting tool when the sonde housing and the rotary cutting tool are mated together, wherein the other of the mounting aperture and the mounting protrusion are provided at the distally directed face of the sonde housing, and wherein the sonde housing defines an angled mounting face that opposes the angled mounting face of the rotary cutting tool when the sonde housing and the rotary cutting tool are mated together.

15. The drilling apparatus of claim 14, wherein the mounting aperture is defined by the sonde housing and the mounting protrusion is defined by the rotary cutting tool, wherein the mounting aperture and the mounting protrusion mate when the sonde housing is mated with the rotary cutting tool, wherein the angled mounting surfaces of the sonde housing and the rotary cutting tool are secured together by fasteners when the rotary cutting tool and the sonde housing are coupled together, wherein a pin extends through the mounting protrusion and the mounting aperture in an orientation that extends along the mount depth, and wherein a fluid flow path is defined through the pin.

16. A drilling apparatus comprising:

a drilling tool including: a drilling tool body that extends along an axis of rotation of the drilling tool between a proximal end of the body and a distal end of the body, the body defining an angled steering face that faces at least partially in a distal direction and that angles toward the axis of rotation as the steering face extends in the distal direction along the axis of rotation, the body also including a proximal face at the proximal end of the body that faces in a proximal direction;

a proximal tail that projects proximally from the proximal face of the body;

a block element that projects proximally from the proximal face of the body, the block element being offset from the axis of rotation of the drilling tool; and the drilling tool defining at least a first socket that extends in a proximal-to-distal direction, the first socket extending through the block element and into the body, wherein the block element defines a perimeter boundary shape having a first portion coextensive with a perimeter outer boundary shape of the drilling tool body and a second portion non-coextensive with the outer boundary shape of the drilling tool body, wherein the perimeter boundary shape of the block is longer along a major axis than a minor axis, and the perimeter boundary shape of the block is non-symmetrical about the major axis.

17. A drilling apparatus comprising:

a drilling tool; and a connection component that mates with the drilling tool at a socket arrangement, the socket arrangement including a recess defined by one of the drilling tool and the connection component and a block defined by the other of the drilling tool and the connection component, one of the recess and the block defining a perimeter boundary shape that is longer along a major axis than a minor axis, the perimeter boundary shape being non-symmetrical about the major axis, and the perimeter boundary shape having a first portion coextensive with a perimeter outer boundary shape of a main body of the drilling tool and a second portion non-coextensive with the outer boundary shape of the main body of the drilling tool, the block fitting within the recess when the connection component and the drilling tool are mated together, the socket arrangement also including a pin that extends through a closed end of the recess and into the block when the connection component and the drilling tool are mated together.

18. The drilling apparatus of claim 17, wherein a fluid passage is defined through the pin.

19. A drilling apparatus comprising: a drilling tool including:

a drilling tool body that extends along an axis of rotation of the drilling tool between a proximal end of the body and a distal end of the body, the body defining an angled steering face that faces at least partially in a distal direction and that angles toward the axis of rotation as the steering face extends in the distal direction along the axis of rotation, the body also including a proximal face at the proximal end of the body that faces in a proximal direction;

a proximal tail that projects proximally from the proximal face of the body;

a block element that projects proximally from the proximal face of the body, the block element defining a perimeter boundary shape having a first portion coextensive with a perimeter outer boundary shape of the drilling tool body and a second portion non-coextensive with the outer boundary shape of the drilling tool body; and the drilling tool defining first and second pin sockets that extend in a proximal-to-distal direction, the first and second pin sockets extending through the block element and into the body, wherein the perimeter boundary shape of the block is longer along a major axis than a minor axis, and the perimeter boundary shape of the block is non-symmetrical about the major axis.

20. The drilling apparatus of claim 19, wherein the block element includes a first cross-dimension that extends along the major axis of the block element, a second cross-dimension that extends along the minor axis of the block element, and a depth that extends along the axis of rotation, wherein the major and minor axes are perpendicular to each other and wherein the first cross-dimension is longer than the second cross-dimension.

21. The drilling apparatus of claim 20, wherein the second cross-dimension is longer than the depth.

22. The drilling apparatus of claim 20, wherein the second cross-dimension is at least twice as long as the depth.

23. The drilling apparatus of claim 20, wherein the second cross-dimension is at least three times as long as the depth.

24. The drilling apparatus of claim 22, wherein the first cross-dimension is at least 1.5 times as long as the second cross-dimension.

25. The drilling apparatus of claim 24, wherein the block element has rounded corners.

26. The drilling apparatus of claim 24, wherein the depth is at least 10 percent as long as the second cross-dimension.

27. The drilling apparatus of claim 24, wherein the depth is at least 20 percent as long as the second cross-dimension.

28. The drilling apparatus of claim 26, wherein the first cross-dimension is at least 25 percent as long as a cutting diameter of the drilling tool.

29. The drilling apparatus of claim 26, wherein the block element is separated from the proximal tail by a spacing, and wherein the axis of rotation extends through the spacing such that the block element is offset form the axis of rotation.

30. The drilling apparatus of claim 26, wherein the proximal tail has a proximal tail length measured in the proximal-to-distal direction, and wherein the proximal tail length is at least 5 times as long as the depth of the block element.

31. The drilling apparatus of claim 26, wherein the proximal tail has a proximal tail length measured in the proximal-to-distal direction, and wherein the proximal tail length is at least 10 times as long as the depth of the block element.

32. The drilling apparatus of claim 30, wherein the proximal tail defines a plurality of fastener openings.

33. The drilling apparatus of claim 30, wherein cutting teeth are provided at the distal end of the drilling tool.

34. The drilling apparatus of claim 20, wherein the minor axis extends in a radial direction relative to the axis of rotation.

35. The drilling apparatus of claim 20, wherein the first and second pin sockets are aligned along the major axis.

36. The drilling apparatus of claim 19, wherein the proximal tail and the block element are unitarily formed with the body.

37. The drilling apparatus of claim 19, further comprising a connection component adapted to mate with the drilling tool, the connection component including a component body having a distal end including a distal face in which a recess is defined, the recess being sized to receive the block element when the connection component and the drilling tool are mated together, the recess having a distal end, a proximal end and a depth that extends between the distal and proximal ends, the distal end of the recess being open and the proximal end being defined at least in part by a recess end surface that faces in a distal direction, the connection component body defining first and second pin mounting openings that extend through the recess end surface proximally into the component body, the connection component also including first and second pins secured within the first and second pin mounting openings, wherein when the connection component and the drilling tool are mated together, the first and second pins of the connection component fit within the first and second pin sockets of the drilling tool and the block element of the drilling tool fits within the recess of the connection component.

38. The drilling apparatus of claim 37, wherein o-ring seals are provided about the first and second pins for providing circumferential seals about the first and second pins within the first and second pin sockets.

39. The drilling apparatus of claim 38, wherein the first and second pins are hollow and provide fluid communication between fluid passages of the connection component and fluid passages of the drilling tool.

40. The drilling apparatus of claim 37, wherein the first and second pins are threaded within the first and second pin mounting openings.

41. The drilling apparatus of claim 37, wherein the recess and the block element have complementary mating transverse cross-sectional shapes.

42. The drilling apparatus of claim 37, wherein the recess has an open side that extends between the distal and proximal ends of the recess.

43. The drilling apparatus of claim 37, wherein the connection component is a sonde housing.

44. The drilling apparatus of claim 37, wherein the component body defines an angled tool mounting face that faces at least partially in a distal direction and is angled relative to the axis of rotation, wherein the proximal tail of the drilling tool is fastened to the angled tool mounting face with a plurality of fasteners used to secure the drilling tool to the component body, and wherein the proximal tail includes a major face that opposes and engages the angled tool mounting face when the drilling tool is secured to the connection component.

45. A drilling tool connection component adapted to mate with a drilling tool, the connection component comprising:

a component body having a distal end including a distal face in which a recess is defined, the recess having a distal end, a proximal end and a depth that extends between the distal and proximal ends, the recess defining a perimeter boundary shape that is longer along a major axis than a minor axis, the recess being non-symmetrical about the major axis, the distal end of the recess being open, a first portion of the perimeter boundary shape of the recess being non-coextensive with a perimeter outer boundary shape of the drilling tool when the connection component is mated with the drilling tool, and the proximal end being defined at least in part by a recess end surface that faces in a distal direction, a second portion of the perimeter boundary shape of the recess being coextensive with the perimeter outer boundary shape of the drilling tool when the connection component is mated with the drilling tool, the connection component body defining first and second pin mounting openings that extend through the recess end surface proximally into the component body, the connection component also including first and second pins secured within the first and second pin mounting openings.

46. The drilling tool connection component of claim 45, wherein the first and second pins are threaded within the first and second pin mounting openings.

47. The connection component of claim 45, wherein the recess has an open side that extends between the distal and proximal ends of the recess.

48. The drilling tool connection component of claim 45, wherein the connection component is a sonde housing.

49. The drilling tool connection component of claim 45, wherein the component body defines an angled tool mounting face that faces at least partially in a distal direction and is angled relative to the axis of rotation, and wherein the angled tool mounting face intersects the distal end face of the component body and defines a plurality of fastener openings.

* * * * *